US008788210B2

(12) United States Patent
Ramshaw et al.

(10) Patent No.: US 8,788,210 B2
(45) **Date of Patent: *Jul. 22, 2014**

(54) JOB MONITORING METHODS AND APPARATUS FOR LOGGING-WHILE-DRILLING EQUIPMENT

(71) Applicant: Schlumberger Technology Corporation, Sugar Land, TX (US)

(72) Inventors: Sylvain Ramshaw, Sugar Land, TX (US); Julian J. Pop, Houston, TX (US); Peter Swinburne, Houston, TX (US); Kai Hsu, Sugar Land, TX (US); Steven Villareal, Houston, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/799,361

(22) Filed: Mar. 13, 2013

(65) Prior Publication Data

US 2013/0192357 A1 Aug. 1, 2013

Related U.S. Application Data

(60) Continuation of application No. 13/252,899, filed on Oct. 4, 2011, now Pat. No. 8,433,520, which is a division of application No. 12/144,185, filed on Jun. 23, 2008, now Pat. No. 8,060,311.

(51) Int. Cl.
*E21B 47/18* (2012.01)

(52) U.S. Cl.
USPC ..... 702/12; 175/40; 175/50; 175/17; 367/183; 367/85; 340/855.3; 340/854.9; 340/870.03; 340/825.52

(58) Field of Classification Search
USPC ..... 702/12; 175/45, 50, 17; 367/183, 85; 340/855.3, 854.9, 870.03, 825.52
See application file for complete search history.

(56) References Cited

U.S. PATENT DOCUMENTS

| | | | | |
|---|---|---|---|---|
| 3,863,203 | A | 1/1975 | Patton | |
| 3,863,665 | A * | 2/1975 | Hechler, IV | 137/218 |
| 4,468,665 | A * | 8/1984 | Thawley et al. | 340/853.2 |
| 4,513,403 | A * | 4/1985 | Troy | 367/83 |
| 5,329,811 | A | 7/1994 | Schultz et al. | |
| 5,448,227 | A * | 9/1995 | Orban et al. | 340/854.4 |
| 5,666,108 | A * | 9/1997 | Duffy | 340/870.03 |
| 5,924,499 | A * | 7/1999 | Birchak et al. | 175/40 |
| 6,176,323 | B1 * | 1/2001 | Weirich et al. | 175/40 |
| 6,272,434 | B1 * | 8/2001 | Wisler et al. | 702/9 |
| 6,753,791 | B2 | 6/2004 | Wei et al. | |
| 6,986,282 | B2 | 1/2006 | Ciglenec et al. | |
| 7,044,238 | B2 * | 5/2006 | Hutchinson | 175/50 |
| 7,114,562 | B2 | 10/2006 | Fisseler et al. | |
| 7,172,037 | B2 | 2/2007 | Dashevskiy et al. | |
| 7,178,608 | B2 | 2/2007 | Mayes et al. | |
| 7,348,892 | B2 * | 3/2008 | Rodney | 340/853.1 |

(Continued)

*Primary Examiner* — Carol S Tsai
(74) *Attorney, Agent, or Firm* — Cathy Hewitt

(57) ABSTRACT

Job monitoring methods and apparatus for logging-while-drilling equipment are disclosed. A disclosed example method includes identifying a downhole scenario based on a property of an underground geological formation, selecting a first telemetry frame type based on the identified downhole scenario, conveying an identifier representative of the selected first telemetry frame type to a downhole fluid sampling tool, and receiving a first telemetry data frame from the downhole fluid sampling tool, the telemetry data frame containing fluid analysis parameters for a fluid, and being constructed in accordance with the selected first telemetry frame type.

18 Claims, 15 Drawing Sheets

(56) References Cited

U.S. PATENT DOCUMENTS

| | | | | |
|---|---|---|---|---|
| 2005/0087368 | A1* | 4/2005 | Boyle et al. | 175/57 |
| 2006/0132330 | A1* | 6/2006 | Youn | 340/870.07 |
| 2007/0057811 | A1* | 3/2007 | Mehta | 340/853.3 |
| 2007/0112521 | A1 | 5/2007 | Akimov et al. | |
| 2008/0253228 | A1* | 10/2008 | Camwell et al. | 367/82 |
| 2009/0282907 | A1 | 11/2009 | Zazovsky et al. | |
| 2009/0301782 | A1* | 12/2009 | Mather et al. | 175/50 |
| 2010/0039286 | A1* | 2/2010 | Robbins | 340/855.3 |
| 2010/0064795 | A1* | 3/2010 | Crocker | 73/152.07 |

* cited by examiner

JOB MONITORING METHODS AND APPARATUS FOR LOGGING-WHILE-DRILLING EQUIPMENT

CROSS-REFERENCE TO RELATED APPLICATIONS

This application is a continuation of U.S. patent application Ser. No. 13/252,899, filed Oct. 4, 2011, now U.S. Pat. No. 8,433,520, which is a divisional of U.S. patent application Ser. No. 12/144,185, filed Jun. 23, 2008, now U.S. Pat. No. 8,060,311, the entire disclosures of which are hereby incorporated by reference.

FIELD OF THE DISCLOSURE

This disclosure relates generally to logging-while-drilling (LWD) equipment and, more particularly, to job monitoring methods and apparatus for LWD equipment.

BACKGROUND

As logging-while-drilling (LWD) tools, modules and/or equipment become more complex, the number of sensors and/or measurements available on a tool and/or drill string has become larger. Downhole sensors may be used to, for example, monitor the status of sampling tools and/or measure physical properties of an underground geological formation fluid. Example measurements include, but are not limited to, flow line fluid resistivity, flow line fluid pressure, flow line fluid temperature, pumped volume, flow line fluid density, flow line fluid viscosity and/or flow line fluid optical spectroscopy at a plurality of wavelengths. Even under minimal or nominal operating conditions, such sensors can generate large quantities of data.

SUMMARY

Job monitoring methods and apparatus for logging-while-drilling (LWD) equipment are disclosed. A disclosed example method includes obtaining a fluid associated with an underground geological formation, analyzing the fluid with one or more sensors to form respective ones of sensor outputs, identifying a downhole scenario associated with the fluid based on the sensor outputs, the identifying being performed while the sensors are within the underground geological formation, and selecting a telemetry frame type based on the identified downhole scenario. Example downhole scenarios includes, but are not limited to, a fluid type, an operating condition, a formation dynamic property, a tool status, a tool condition, a drilling fluid or mud type, a sampling regime, and/or any other property and/or attribute of a formation, a wellbore, a downhole tool or a formation fluid.

A disclosed example downhole LWD tool apparatus includes a sensor to measure a property of an underground geological formation fluid, an analyzer to identify a downhole scenario based on the property, and a telemetry frame type selector to select a telemetry frame type based on the identified downhole scenario.

Another disclosed example method includes identifying a downhole scenario based on a property of an underground geological formation, selecting a telemetry frame type based on the identified downhole scenario, conveying an identifier representative of the selected telemetry frame type to a downhole fluid sampling tool, and receiving a telemetry data frame from the downhole fluid sampling tool, the telemetry data frame containing fluid analysis parameters for a fluid, and being constructed in accordance with the selected telemetry frame type.

A disclosed example apparatus for use with a downhole LWD tool includes an analyzer to identify a downhole scenario based on a property of an underground geological formation, a telemetry frame type selector to select a telemetry frame type based on the identified downhole scenario, and a telemetry transceiver to convey an identifier representative of the selected telemetry frame type to a downhole fluid sampling tool.

Yet another disclosed example method includes obtaining a fluid associated with an underground geological formation, measuring one or more properties of the fluid with one or more sensors, determining whether a fault condition exists, selecting a telemetry frame type based on whether the fault condition exists, and sending a telemetry frame containing the one or more properties, wherein the telemetry frame is constructed in accordance with the selected telemetry frame type.

DETAILED DESCRIPTION

Figure 1:
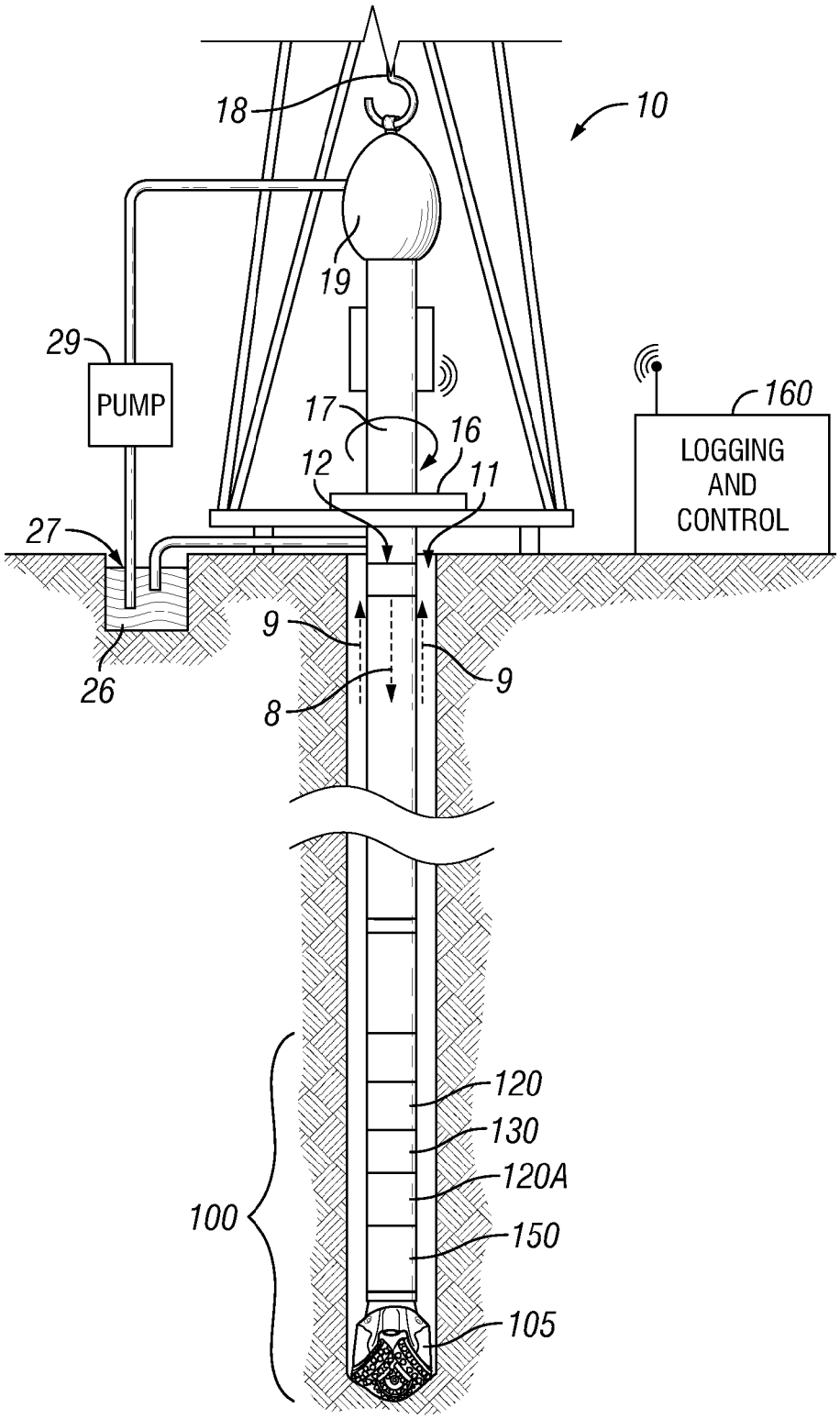
FIG. 1 illustrates an example wellsite drilling system.

During LWD operations that use, for example, mud pulse telemetry to transmit data from a tool string to a surface computer, there may be a limited amount of data that can be transmitted during any given period of time. In particular, it may not be possible to transmit all desired sensor outputs at their preferred precisions with presently available telemetry data transmission technologies. For example, a sequence of saturation images obtained from the region around a sampling probe or of a wellbore, and/or video of flow line contents as fluids are being pumped can easily exceed the transmission capabilities of mud-based telemetry data transmission systems and, in some instances, even the data transmission capabilities of wired drill pipe telemetry systems. Some existing wireline telemetry systems even have difficulty transmitting the relatively coarse optical density image data available in current downhole tool strings.

To facilitate adequate monitoring of an LWD operation at the surface, downhole measurements should be made available at an acceptable frequency (e.g., at least every 15 to 30 seconds). However, mud pulse telemetry may be limited to a transmission rate of 3 bits per second (bps), although the achievable data rate depends on a large number of factors such as, depth of well, type of mud, etc. As a consequence, only about 180 bits can be transmitted each minute. In instances where tool conditions, formation properties and/or formation fluid properties change slowly, such data rates may be sufficient. When flow line contents are heterogeneous and/or changing quickly or often (e.g., with every pump stroke), such limited data rates can result in incomplete and/or inadequate knowledge of what is happening within the sampling tool and/or the wellbore. For example, if the telemetry data rate only allows for sensor output data to be conveyed for every other pump stroke, even though one or more properties are changing with every pump stroke, an operator may not be able to determine what is happening within the wellbore and/or sampling tool. Such conditions can, for example, occur when an optical spectrometer is located on the downstream side of the pumpout, and segregation takes place within the pumpout displacement unit, depending on the pumpout rate. Alternatively, downhole measurements may be interpreted within the sampling tool, which compresses the analysis results and sends them to the surface.

To overcome at least these deficiencies, the example methods and apparatus disclosed herein utilize reduced precision and/or reduced sets of sensor measurements to identify downhole scenarios. Example downhole scenarios include, but are not limited to, a formation fluid type (also referred to herein as simply fluid type), an operating condition, a formation dynamic property, a tool status, a tool condition, a drilling fluid or mud type, a sampling regime and/or any other property and/or attribute of a formation, a wellbore, a downhole tool or a formation fluid. Based upon an identified downhole scenario such as an identified fluid type (e.g., water, gas, black oil, volatile oil, gas condensate, etc.), a particular telemetry data frame type is selected. Each telemetry data frame type defines the subset of sensor outputs to be conveyed within the data frame, as well as their associated precisions. By adjusting, in situ and over time, the telemetry data frame type being used to convey sensor data between downhole tools and the surface, an operator is provided with adequate information to make real-time job management decisions. For example, different measurements are pertinent and/or useful for different downhole scenarios.

While example methods and apparatus are described herein with reference to so-called "sampling-while-drilling," "logging-while-drilling," and/or "measuring-while drilling" operations, the example methods and apparatus may, additionally or alternatively, be used to determine which data to send between a tool string and the surface during other types of logging, measuring and/or sampling operations. Moreover, such while-drilling operations do not require that sampling, logging and/or measuring actually occur while drilling is actively taking place. For example, as commonly performed in the industry, a drill bit of a drill string drills for a period of time, drilling is paused, one or more formation measurements, formation fluid measurements and/or formation fluid samples are taken by one or more sampling, measuring and/or logging devices of the drill string, and then drilling is resumed. Such activities are referred to as sampling, measuring and/or logging while drilling operations because they do not require the removal of a drill string from the borehole to perform formation measurements, to perform formation fluid measurements and/or to obtain formation fluid samples. The example methods and apparatus described herein may also be used with other types of downhole components not associated with drilling operations. For example, permanent sensors and/or other types of sampling tools, such as an acoustic tool, a coring tool, etc. In an example, an acoustic tool sends a representation of a first waveform with low precision to capture all aspects of the wave, and then sends a representation of a portion of the waveform with a higher precision. As used herein, the term "fluid" refers to any fluid comprising any combination of formation fluid and/or mud contained, captured, stationary and/or flowing in and/or through any portion of downhole tool (e.g., a flowline and/or a sample container). As used herein, the term "fluid type" is used to distinguish between categories of fluids (e.g., liquid versus gas versus water versus oil etc.) and to distinguish fluids within a fluid category (e.g., heavy oil versus medium oil versus light oil etc.

Certain examples are shown in the above-identified figures and described in detail below. In describing these examples, like or identical reference numbers may be used to identify common or similar elements. The figures are not necessarily to scale and certain features and certain views of the figures may be shown exaggerated in scale or in schematic for clarity and/or conciseness. Moreover, while certain preferred embodiments are disclosed herein, other embodiments may be utilized and structural changes may be made without departing from the scope of the invention.

FIG. 1 illustrates an example wellsite drilling system that can be employed onshore and/or offshore. In the example wellsite system of FIG. 1, a borehole 11 is formed in one or more subsurface formations by rotary and/or directional drilling.

As illustrated in FIG. 1, a drill string 12 is suspended within the borehole 11 and has a bottom hole assembly (BHA) 100 having a drill bit 105 at its lower end. A surface system includes a platform and derrick assembly 10 positioned over the borehole 11, the assembly 10 includes a rotary table 16, a kelly 17, a hook 18 and a rotary swivel 19. The drill string 12 is rotated by the rotary table 16, energized by means not shown, which engages the kelly 17 at the upper end of the drill string 12. The example drill string 12 is suspended from the hook 18, which is attached to a traveling block (not shown), and through the kelly 17 and the rotary swivel 19, which permits rotation of the drill string 12 relative to the hook 18. Additionally or alternatively, a top drive system could be used.

In the example of FIG. 1, the surface system further includes drilling fluid 26, which is commonly referred to in the industry as "mud," stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid 26 exits the drill string 12 via ports in the drill bit 105, and then circulates upwardly through the annulus region between the outside of the drill string and the wall of the borehole, as indicated by the directional arrows 9. The drilling fluid 26 lubricates the drill bit 105, carries formation cuttings up to the surface as it is returned to the pit 27 for recirculation, and creates a mudcake layer (not shown) on the walls of the borehole 11.

The example BHA 100 of FIG. 1 includes, among other things, any number and/or type(s) of logging-while-drilling (LWD) modules (two of which are designated at reference numerals 120 and 120A) and/or measuring-while-drilling (MWD) modules (one of which is designated at reference numeral 130), a rotary-steerable system or mud motor 150, and the example drill bit 105.

The example LWD modules 120 and 120A of FIG. 1 are each housed in a special type of drill collar, as it is known in the art, and each contain any number of logging tools and/or fluid sampling devices. The example LWD modules 120, 120A include capabilities for measuring, processing, and/or storing information, as well as for communicating with the MWD module 150 and/or directly with surface equipment, such as a logging and control computer. An example manner of implementing either or both of the LWD modules 120, 120A is described below in connection with FIG. 2.

An example manner of implementing a data module for either or both of LWD modules 120, 120A, which uses identified downhole scenarios to select data to be conveyed in telemetry data frames, is described below in connection with FIG. 3. Additionally or alternatively, all or a portion of the example data module of FIG. 3 may be implemented by the MWD module 130 and/or the example logging and control computer 160. For example, measurements may be taken by one or more LWD modules 120, 120A and conveyed via, for example, a general-purpose telemetry data frame to the logging and control computer 160, which identifies a downhole scenario based on the measurements, selects a telemetry data frame type, and sends the selected telemetry data frame type to the LWD module(s) 120, 120A and/or the MWD module 130. Subsequently, the LWD module(s) 120, 120A and/or the MWD module 130 selects sensor outputs and associated precisions based on the telemetry data frame type, and sends the selected sensor outputs to the surface computer 160 via one or more telemetry data frames constructed in accordance with the telemetry data frame type.

Other example manners of implementing an LWD module 120, 120A or the MWD module 130 are described in U.S. Pat. No. 7,114,562, entitled "Apparatus and Method For Acquiring Information While Drilling," and issued on Oct. 3, 2006; and in U.S. Pat. No. 6,986,282, entitled "Method and Apparatus For Determining Downhole Pressures During a Drilling Operation," and issued on Jan. 17, 2006. U.S. Pat. No. 7,114,562, and U.S. Pat. No. 6,986,282 are hereby incorporated by reference in their entireties.

The example MWD module 130 of FIG. 1 is also housed in a special type of drill collar and contains one or more devices for measuring characteristics of the drill string 12 and/or the drill bit 105. The example MWD tool 130 further includes an apparatus (not shown) for generating electrical power for use by the downhole system 100. Example devices to generate electrical power include, but are not limited to, a mud turbine generator powered by the flow of the drilling fluid, and a battery system. Example measuring devices include, but are not limited to, a weight-on-bit measuring device, a torque measuring device, a vibration measuring device, a shock measuring device, a stick slip measuring device, a direction measuring device, and an inclination measuring device. The MWD module 130 also includes capabilities for communicating with surface equipment, such as the logging and control computer 160, using any past, present or future two-way telemetry system such as a mud-pulse telemetry system, a wired drill pipe telemetry system, an electromagnetic telemetry system and/or an acoustic telemetry system.

Figure 2:
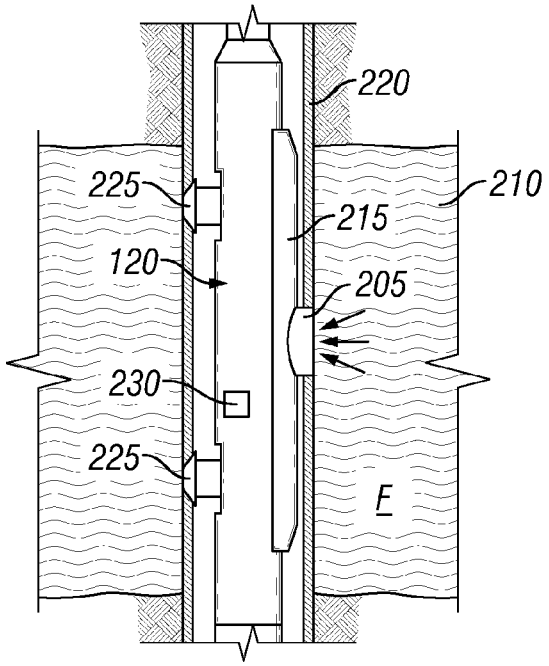
FIG. 2 illustrates an example manner of implementing either or both of the example logging while drilling (LWD) modules of FIG. 1.

FIG. 2 is a schematic illustration of an example manner of implementing either or both of the example LWD modules 120 and 120A of FIG. 1. While either or both of the example LWD modules 120 and 120A of FIG. 1 may be represented by the example device of FIG. 2, for ease of discussion, the example device of FIG. 2 will be referred to as LWD module or tool 120. The example LWD tool 120 of FIG. 2 is provided with a probe 205 for establishing fluid communication with the formation F and to draw a fluid 210 into the tool 120, as indicated by the arrows. The example probe 205 may be positioned, for example, within a stabilizer blade 215 of the LWD tool 120 and extended from the stabilizer blade 215 to engage a borehole wall 220. An example stabilizer blade 215 comprises one or more blades that are in contact with the borehole wall 220. The fluid 210 drawn into the downhole tool 120 using the probe 205 may be measured to determine, for example, viscosity, fluid density, optical density, absorbance, etc. Additionally, the LWD tool 120 may be provided with devices, such as sample chambers (not shown), for collecting fluid samples for retrieval at the surface. Backup pistons 225 may also be provided to assist in applying force to push the drilling tool 120 and/or the probe 205 against the borehole wall 220.

To make formation and/or fluid measurements, the example LWD module 120 of FIG. 2 includes a data module 230. As described in detail below in connection with FIG. 3, the example data module 230 of FIG. 2 includes any number and/or type(s) of sensors 305, 306 that may be used to take measurements of formations and/or fluids. The example data module 230 selects outputs of the sensors 305, 306 based upon a selected telemetry data frame type, and creates or populates telemetry data frames using the selected sensor outputs. For some telemetry data frame types, the sensor outputs may be processed before being used to populate a telemetry data frame. For example, the number of bits used to represent a sensor output may be reduced and/or a sensor output may be filtered to, for example, reduce noise present in the sensor output. In some examples, the data module 230 receives a value representative of the selected telemetry data frame type from the example surface computer 160. Additionally or alternatively, the data module 230 includes an analyzer 330 to identify a downhole scenario, which uses a telemetry frame selector 335 to select the telemetry data frame type. While the data module 230 is depicted as part of the LWD module 120 in FIG. 2, the data module may alternatively by implemented partially in the LWD module 120 and partially in the MWD module 130.

Figure 3:
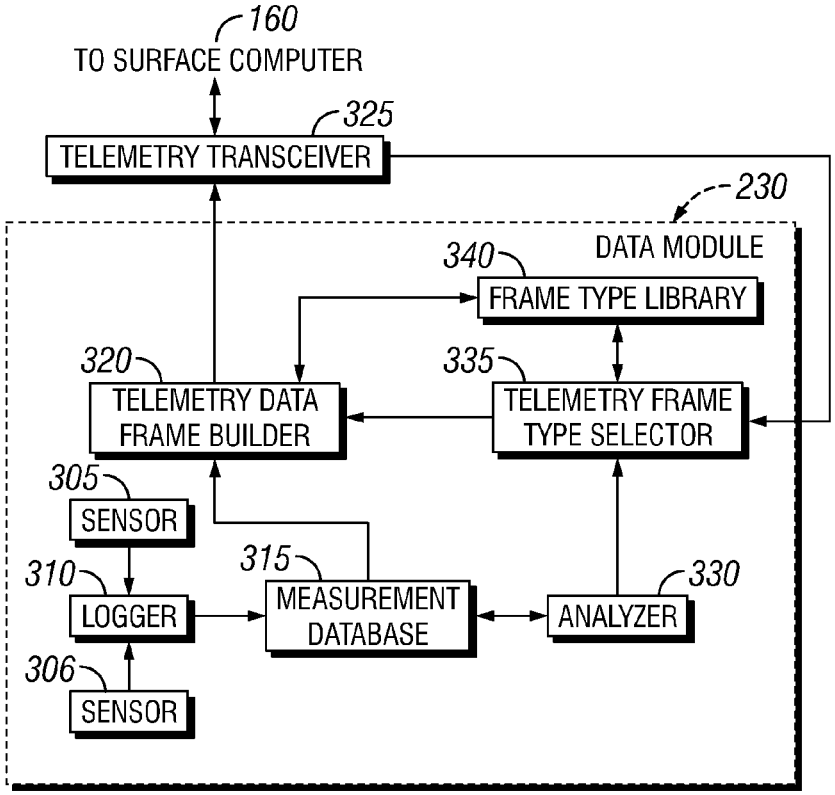
FIG. 3 is a schematic diagram of an example manner of implementing the example data module of FIG. 2.

FIG. 3 illustrates an example manner of implementing the example data module 230 of FIG. 2. To take measurements, the example data module 230 of FIG. 3 includes any number and/or type(s) of sensors, two of which are designated at reference numerals 305 and 306. The example sensors 305 and 306 of FIG. 3 take one or more measurements of an underground geological formation and/or formation fluid(s). Example measurements include, but are not limited to, flow fluid line resistivity, flow line fluid pressure, flow line fluid temperature, pumped volume, flow line fluid optical spectroscopy at a plurality of wavelengths, sampling pressure, flow line fluid resistivity, flow line fluid density, flow line fluid florescence, flow line fluid magnetic resonance, flow line fluid chemical composition, pH, PVT (pressure-volume-temperature) behavior, a nuclear measurement, a density measurement, a resistivity/conductivity measurement, a nuclear magnetic resonance (NMR) measurement, an electromagnetic (EM) propagation measurement, etc. An output of any of the example sensors 305 and 305 may be: (a) an analog and/or digital signal, (b) may be digitized representation of an analog signal, (c) processed to reduce noise, (d) processed to reduce the number of bits used to represent the output, (e) processed in accordance with a model used to interpret the sensor output, and/or (f) may be a parameter derived from a sensor output.

To record measurements taken by the example sensors 305 and 306, the example in a module 230 FIG. 3 includes a logger 310 and a measurement database 315. Example logger 310 FIG. 3 collects measurements taken by the sensors 305 and 306, and stores and/or logs them in the example measurement database 315. In some examples, measurements are stored in the measurement database 315 together with associated timestamps that represent when the measurements were taken. The measurements may be stored in the measurement database 315 using any number and/or type(s) of data structures and/or records, and the example measurement database 315 may be implemented by any number and/or type(s) of memory(-ies) and/or memory device(s).

To create telemetry data frames, the example data module 230 of FIG. 3 includes a telemetry data frame builder 320. Based on the type of telemetry data frame to be transmitted, the example telemetry data frame builder 320 of FIG. 3 selects one or more measurements from the measurement database 315. In some examples, telemetry data frame types also define a precision (e.g., the number of bits used to represent a measurement) for each of the measurements to be sent. The example telemetry data frame builder 320 constructs a telemetry data frame in accordance with the telemetry data frame type using the selected measurements and associated precisions. Example telemetry data frame types are described below in connection with FIGS. 7 and 10.

The example telemetry data frame builder 320 of FIG. 3 provides created telemetry data frames to a telemetry transceiver 325. The example telemetry transceiver 325 of FIG. 3 transmits physical-layer telemetry data frames to the surface and receives physical-layer telemetry data frames from the surface. Physical-layer telemetry data frames may be, for example, transmitted and/or received using a mud pulse telemetry technology and/or any other type(s) of telemetry technologies (such as a wireline telemetry technology, a wired drill pipe telemetry technology, an electromagnetic telemetry technology, an acoustic telemetry technology, an optical fiber telemetry technology and/or any other technology capable of transporting data from a downhole tool to a surface device). The data module 230, the telemetry data frame builder 320 and the telemetry transceiver 325 may be implemented within the same or different downhole components. For example, a telemetry data frame builder 320 implemented by the LWD module 120 populates and encodes a logical telemetry data frame based on a telemetry data frame type, and sends the logical telemetry data frame to the MWD module 130. A second telemetry data frame builder 320 or a telemetry transceiver 325 implemented by the MWD module 130 builds, forms or constructs a physical-layer telemetry data frame adapted to the currently employed telemetry technology, and populates the physical-layer telemetry data frame with data provided by one or more of the LWD tools 120, 120A (e.g., the logical telemetry data frame), oblivious to that data's format. Thus, a physical-layer telemetry data frame transmitted by the telemetry transceiver 325 may contain one or more logical telemetry data frames created or populated by one or more LWD modules 120, 120A. A physical layer telemetry data frame may, additionally or alternatively, include a logical telemetry data frame created by a data module 230 implemented by the MWD module 130.

To analyze measurements taken by the example sensors 305 and 306, the example data module 230 of FIG. 3 includes one or more analyzers, one of which is designated at reference numeral 330. Using any number and/or type(s) of algorithm(s), method(s) and/or logic, the example analyzer 330 of FIG. 3 identifies a downhole scenario corresponding to a set of measurements. The example analyzer 330 may use any or all of the following when identifying a downhole scenario: a database of local or typical fluid types, compositions and/or properties that may be expressed as equations of state, as property correlations or as neural networks; information relating to the physical properties of the formation, such as lithology, porosity, permeability(-ies) and/or their distribution, in-situ stress, mechanical strength and drawdowns which would induce formation collapse and/or the onset of sanding; a description of the drilling fluid and/or its associated properties, such as composition, density, rheological properties, filtration characteristics and/or changes in behavior with pressure and temperature; mud cake properties including, but not limited to, thickness, porosity, permeability and/or filtration characteristics; historical and/or regionally specific sampling information; sensor performance characteristics, such as accuracy, repeatability, resolution and/or calibration data; and/or tool component performance, such as pump, valve, actuator performance curves or equations. Example processes that may be carried out to implement the example analyzer 330 are described below in connection with FIGS. 9A and 9B.

To select a telemetry data frame type based on an identified fluid type, formation property and/or downhole scenario, the example data module 230 of FIG. 3 includes the example telemetry data frame selector 335. The example telemetry data frame selector 335 of FIG. 3 selects a telemetry data frame type from a frame type library 340 based on a downhole scenario identified by the example analyzer 330. Additionally or alternatively, the example telemetry data frame selector 335 selects a telemetry data frame type based on a frame type identifier received in a telemetry command frame from the surface computer 160 via the telemetry transceiver 325. In such instances, downhole scenario determinations may be made by the surface computer 160 and/or by an operator of the surface computer 160 based on measurements provided by the data module 230 to the surface computer 160 in, for example, one or more general-purpose telemetry data frames. Such general-purpose telemetry data frames may be used to provide a sufficient number and/or type(s) of measurements to enable downhole scenario determinations, and at low-enough precisions so as to be transmittable in the available telemetry bandwidth. An example general purpose telemetry data frame includes a flow line pressure and a flow line flow rate to allow an operator to determine if a proper seal has been achieved against a formation surface, and also includes properties of a fluid that enable a fluid type determination to be made.

Once a downhole scenario determination is made, a selected telemetry data frame type is used to convey, for example, fewer but higher-precision sensor measurements to more accurately represent what is occurring in the downhole tool, wellbore and/or formation. In the examples described herein, there are a plurality of special-purpose telemetry frame types for respective ones of a plurality of downhole scenarios. For example, if a strong methane signal is detected and the drilling fluid comprises an oil-based mud, then a methane-centric special-purpose telemetry data frame containing optical densities concentrated at methane, carbon dioxide and oil sensitive wavelengths in the near infrared would be selected. While general-purpose telemetry data frames convey information to facilitate an identification of a downhole scenario, special-purpose telemetry data frames convey information to facilitate a decision whether to take and/or collect a fluid sample. In particular, special-purpose telemetry data frames provide more detailed information about a subset of downhole scenarios to facilitate a more precise characterization of the formation and/or fluid. For example, if the measured properties of a current fluid currently being pumped from the formation and/or reservoir are sufficiently or substantially similar to an already sampled fluid, then it may not be desirable to collect a fluid sample in order to conserve a sampling container for later use.

During a while-drilling operation any sequence(s) of general-purpose and/or special-purpose telemetry data frame types may be employed. For example, data contained in one or more general-purpose telemetry data frames is used to identify a downhole scenario, the downhole scenario is used to select a first special-purpose telemetry data frame type, data contained in one or telemetry data frames constructed in accordance with the first special-purpose telemetry data frame type can be used to make one or more additional downhole scenario determinations that are subsequently used to select a second special-purpose telemetry data frame type and/or to return to the general-purpose telemetry data frame type.

In some examples, the telemetry data frame selector 335 is pre-programmed with a sequence of telemetry data frame types to use at different wellbore positions and/or depths. Such sequences of telemetry data frame types may be determined, for example, based on measurements taken in an offset well drilled into the same underground formation and/or based on a basin model that models how fluids are distributed in an underground formation. A sequence of telemetry data frame types may include any sequence of general-purpose and/or special-purpose telemetry data frame types depending on expected downhole scenario(s). Additionally or alternatively, identified downhole scenarios, and/or selected telemetry frame types are logged in the example measurement database 315 to facilitate subsequent analysis and/or review.

In other examples, the example analyzer 330 and the example sensors 305 and 306 can take and analyze one or more measurements that enable the telemetry data frame builder 320 to not send a general-purpose data frame prior to sending a special-purpose data frame. For example, nuclear, density, resistivity/conductivity, NMR, and/or EM propagation measurements may allow a fluid type to be identified without needing to draw a formation fluid into the LWD tool 120.

Telemetry data frame types may be stored and/or represented in the example frame type library 340 using any number and/or type(s) of data structures, and the frame type library 340 may be implemented by any number and/or type(s) of memory(-ies) and/or memory device(s).

While an example manner of implementing the example data module 230 of FIG. 2 has been illustrated in FIG. 3, one or more of the interfaces, data structures, elements, processes and/or devices illustrated in FIG. 3 may be combined, divided, re-arranged, omitted, eliminated, implemented in a recursive way, and/or implemented in any other way. For example, the example analyzer 330 may be implemented by the example surface computer 160. Further, the example sensors 305 and 306, the example logger 310, the example measurement database 315, the example telemetry data frame builder 320, the example telemetry transceiver 325, the example analyzer 330, the example telemetry data frame selector 335, the example frame type library 340 and/or, more generally, the example data module 230 of FIG. 3 may be implemented by hardware, software, firmware and/or any combination of hardware, software and/or firmware. Thus, for example, any or all of the example sensors 305 and 306, the example logger 310, the example measurement database 315, the example telemetry data frame builder 320, the example telemetry transceiver 325, the example analyzer 330, the example telemetry data frame selector 335, the example frame type library 340 and/or, more generally, the example data module 230 may be implemented by one or more circuit(s), programmable processor(s), application specific integrated circuit(s) (ASIC(s)), programmable logic device(s) (PLD(s)) and/or field programmable logic device(s) (FPLD(s)), etc. Further still, a data module may include interfaces, data structures, elements, processes and/or devices instead of, or in addition to, those illustrated in FIG. 3 and/or may include more than one of any or all of the illustrated interfaces, data structures, elements, processes and/or devices.

Figure 4:
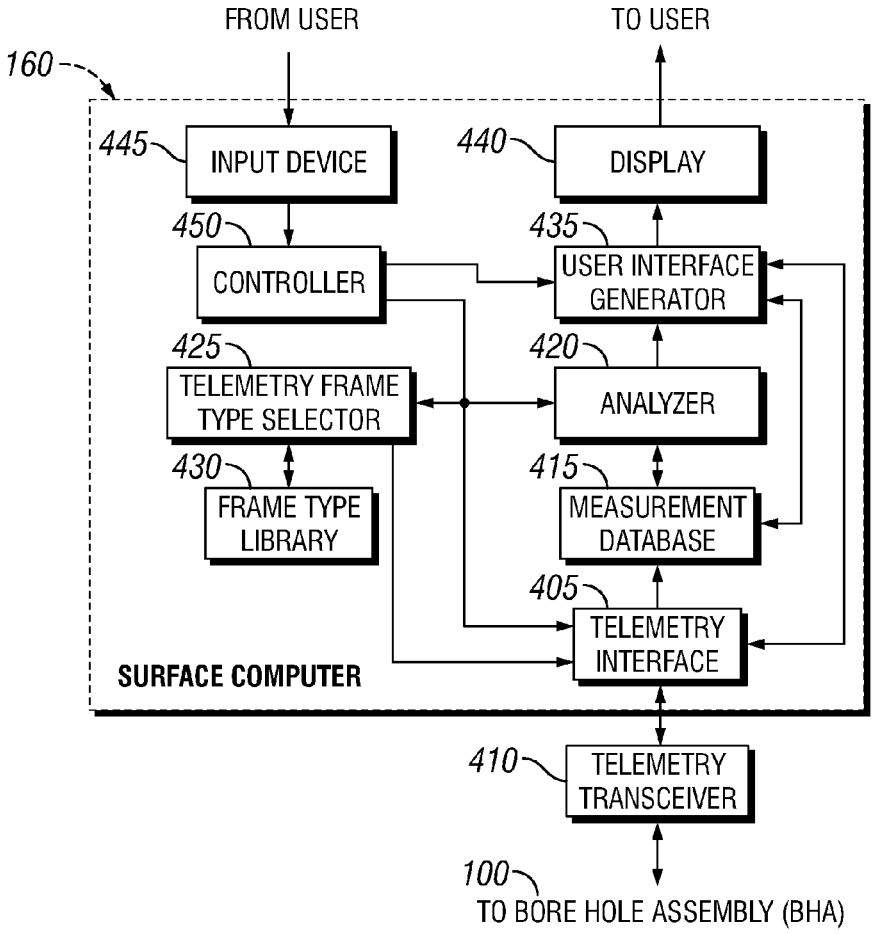
FIG. 4 is a schematic diagram of an example manner of implementing the example logging and control surface computer of FIG. 1.

FIG. 4 illustrates an example manner of implementing the example surface computer 160 of FIG. 1. Additionally or alternatively, the example device of FIG. 4 may be used in addition to and/or in conjunction with the example surface computer 160. In some examples, the example surface computer 160 of FIG. 4 may be positioned and/or operated remotely from a wellsite (e.g., in a remote office). To interact with the example BHA 100, the example surface computer 160 of FIG. 4 includes a telemetry interface 405. The example telemetry interface 405 of FIG. 4 sends commands to the BHA 100 and/or receives telemetry data frames from the BHA 100 via a telemetry transceiver 410. Example commands that may be sent to the BHA 100 include, but are not limited to, an approach station command, a station measurement command, and/or a telemetry frame type command. The telemetry frame type command is used to direct the BHA 100 to send telemetry data frames of a particular type, such as a general-purpose type useful for making downhole scenario identifications, and/or a special-purpose type to facilitate more accurate monitoring of a fluid sampling operation.

The example telemetry transceiver 410 of FIG. 4 transmits telemetry commands to the BHA 100 and receives telemetry data frames from the BHA 100. Telemetry data may be, for example, transmitted and/or received using a mud pulse telemetry technology and/or other type(s) of telemetry technologies (such as a wireline telemetry technology, a wired drill pipe telemetry technology, an electromagnetic telemetry technology, an acoustic telemetry technology, an optical fiber telemetry technology and/or any other technology capable of transporting data from a downhole tool to a surface device). The surface computer 160 and the telemetry transceiver 410 may be implemented within the same or a different wellsite component. For example, the surface computer 160 may be implemented separately from the telemetry transceiver 410 and be communicatively coupled to the telemetry transceiver 410 via a wireless and/or wired communication path.

To store measurements received in telemetry data frames, the example surface computer 160 of FIG. 4 includes a measurement database 415. Measurements may be stored in the example measurement database 415 of FIG. 4 using any number and/or type(s) of data structures, and the example measurement database 415 may be implemented by any number and/or type(s) of memory(-ies) and/or memory device(s).

To analyze measurements received from the BHA 100, the example surface computer 160 of FIG. 4 includes one or more analyzers, one of which is designated at reference numeral 420. Using any number and/or type(s) of algorithm(s), method(s) and/or logic, the example analyzer 420 of FIG. 4 identifies a downhole scenario corresponding to a set of received measurements. The example analyzer 420 may use any or all of the following when identifying a downhole scenario: a database of local or typical fluid types, compositions and/or properties that may be expressed as equations of state, as property correlations or as neural networks; information relating to the physical properties of the formation, such as lithology, porosity, permeability(-ies) and/or their distribution, in-situ stress, mechanical strength and drawdowns which would induce formation collapse and/or the onset of sanding; a description of the drilling fluid and/or its associated properties, such as composition, density, rheological properties, filtration characteristics and/or changes in behavior with pressure and temperature; mud cake properties including, but not limited to, thickness, porosity, permeability and/or filtration characteristics; historical and/or regionally specific sampling information; sensor performance characteristics, such as accuracy, repeatability, resolution and/or calibration data; and/or tool component performance, such as pump, valve, actuator performance curves or equations. Example processes that may be carried out to implement the example analyzer 420 are described below in connection with FIGS. 9A and 9B.

To select a telemetry data frame type based on an identified downhole scenario, the example surface computer 160 of FIG. 4 includes a telemetry frame type selector 425. The example telemetry frame type selector 425 of FIG. 4 selects a telemetry frame type from a frame type library 430 based on a downhole scenario identified by the example analyzer 420. When a telemetry frame type is selected by the telemetry frame type selector 425, a telemetry frame type command is sent to the BHA 100 via the telemetry interface 405. When the telemetry frame type command is received by the BHA 100, the BHA 100 starts sending telemetry data frames that are constructed in accordance with the specified telemetry frame type. In some examples, the BHA 100 continues constructing telemetry data frames in accordance with the specified telemetry frame type until a new telemetry frame type command is received. Additionally or alternatively, a telemetry frame type command may include a number that represents either the number of telemetry frames to be constructed based on the telemetry frame type and/or a time duration before reverting to a general-purpose telemetry frame type. In some examples, identified downhole scenarios, and/or selected telemetry frame types are logged in the example measurement database 415 to facilitate subsequent analysis and/or review.

Telemetry frame types may be stored and/or represented in the example frame type library 430 of FIG. 4 using any number and/or type(s) of data structures, and the frame type library 430 may be implemented by any number and/or type(s) of memory(-ies) and/or memory device(s).

To display information for use by a user and/or operator, the example surface computer 160 of FIG. 4 includes a user interface generator 435 and a display 440. The example user interface generator 435 of FIG. 4 generates, for example, one or more representations (e.g., graphs) of measurement data received via the example telemetry interface 405 and/or stored in the example measurement database 415. Example interfaces created by the example user interface generator 435 are described below in connection with FIGS. 6 and 8. The example display 440 of FIG. 4 is any type of display, such as a computer monitor.

To receive user inputs and/or selections, the example surface computer 160 of FIG. 4 includes any number and/or type(s) of input devices, one of which is designated at reference numeral 445. Example input devices 445 include, but are not limited, to a touch screen, a mouse, and/or a keyboard. In an example, received measurement data is displayed by the user interface generator 425 at the display 440, and an operator identifies a downhole scenario based on the displayed measurement data and enters the identified downhole scenario into the surface computer 160 via the input device 445 using, for example, a drop down menu of listing a plurality of downhole scenarios. A controller 450 receives the entered downhole scenario and directs the example telemetry frame type selector 425 to select a corresponding telemetry frame type and to convey the same to the BHA 100 via the telemetry interface 405. In another example, the operator identifies a downhole scenario and special-purpose telemetry frame type based on the displayed measurement data and (a) enters the identified frame type into the surface computer 160 via the input device 445 using, for example, a drop down menu listing a plurality of telemetry frame types and/or (b) directly communicate the selected telemetry frame type directly to the BHA 100 via the telemetry interface 405. In yet another example, the controller 450 directs the analyzer 420 to, periodically and/or aperiodically, identify a downhole scenario based on received measurement data, directs the telemetry frame type selector 425 to select a corresponding telemetry frame type and to convey the same to the BHA 100 via the telemetry interface 405, and also directs the user interface generator 435 to present the identified downhole scenario at the display 440. The example controller 450 of FIG. 4 may be one or more general-purpose processors, processor cores, microcontrollers, etc.

While an example manner of implementing a surface computer 160 of FIG. 1 has been illustrated in FIG. 4, one or more of the interfaces, data structures, elements, processes and/or devices illustrated in FIG. 4 may be combined, divided, rearranged, omitted, eliminated and/or implemented in any other way. For example, the example analyzer 420, the example telemetry frame type selector 425, and/or the example frame type library 430 may be implemented by the example data module 230 of FIG. 3. Further, the example telemetry interface 405, the example telemetry transceiver 410, the example measurement database 415, the example analyzer 420, the example telemetry frame type selector 425, the example frame type library 430, the example user interface generator 435, the example display 440, the example input device 445, the example controller 450 and/or, more generally, the example surface computer 160 of FIG. 4 may be implemented by hardware, software, firmware and/or any combination of hardware, software and/or firmware. Thus, for example, any or all of the example telemetry interface 405, the example telemetry transceiver 410, the example measurement database 415, the example analyzer 420, the example telemetry frame type selector 425, the example frame type library 430, the example user interface generator 435, the example display 440, the example input device 445, the example controller 450 and/or, more generally, the example surface computer 160 may be implemented by one or more circuit(s), programmable processor(s), ASIC(s), PLD(s) and/or FPLD(s), etc. Further still, a surface computer may include interfaces, data structures, elements, processes and/or devices instead of, or in addition to, those illustrated in FIG. 4 and/or may include more than one of any or all of the illustrated interfaces, data structures, elements, processes and/or devices.

Figure 5:
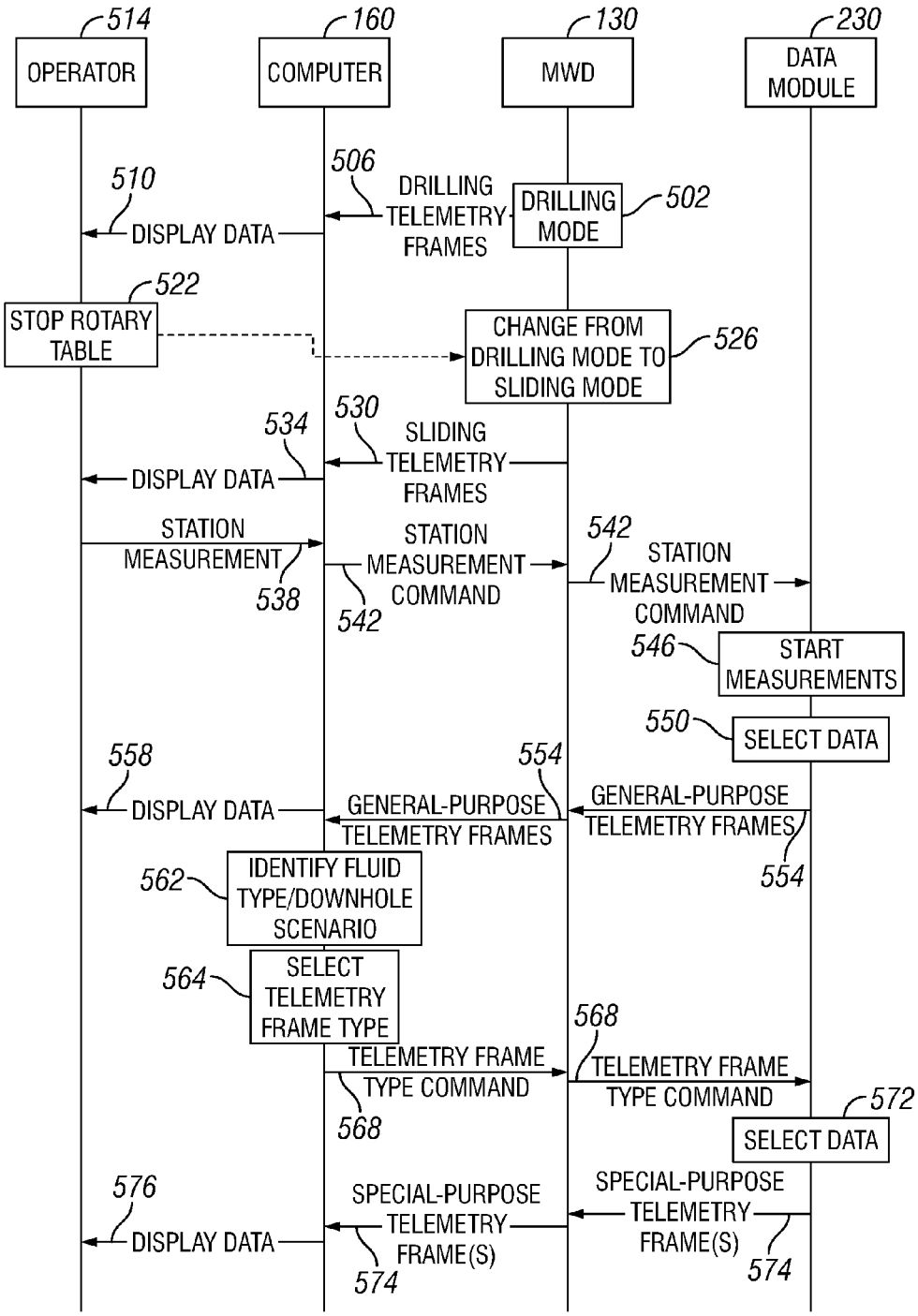
FIG. 5 illustrates example operations of the example data modules and the example logging and control surface computers disclosed herein.

FIG. 5 illustrates an example operational scenario for the example wellsite equipment of FIG. 1. The example operational scenario of FIG. 5 is only one example of how the example methods and apparatus disclosed herein may be operated. Any number and/or type(s) of additional or alternative interactions and/or exchanges may be used to determine a downhole scenario, and/or to specify, select, construct and/or convey telemetry data frame types and/or telemetry data frames. For example, in the example scenario of FIG. 5, the example MWD 130 implements and/or includes the telemetry transceiver 325 and, thus, all commands and/or telemetry data frames flowing to and/or from the data module 230 pass through the MWD 130. However, such commands and/or telemetry data frames need not flow through the MWD 130 but instead could be directly received and transmitted by a telemetry transceiver included in the data module 230. Moreover, the operator 514 can send commands to the MWD 130 and/or the data module 230 without the involvement of the computer 160.

The example operational scenario of FIG. 5 begins with the example MWD module 130 operating in a drilling mode (block 502) and sending telemetry data frames 506 containing data measurements associated with the drilling operation and/or formation evaluation data, such as resistivity, and/or natural gamma ray. The surface computer 160 receives the telemetry data frames 506 and displays 510 the received data for an operator 514.

When the operator 514 determines that the BHA 100 should be positioned for formation measurements, the operator 514 stops the rotation of the rotary table 16 (block 522). The MWD 130 senses that drilling has stopped (e.g., by detecting that the rotary table 16 has stopped rotating or the mud pump 29 has stopped) and changes from drilling mode to sliding mode (block 526). The MWD 130 starts sending telemetry data frames 530 containing information representing the current downhole scenario. Such information may include, for example, gamma ray sensor data, orientation sensor data, formation evaluation data for depth correlation, toolface sensor data, etc. In the illustrated example of FIG. 5, the example telemetry data frames 530 are sliding telemetry data frames. The computer 160 receives the telemetry data frames 530 and displays 534 the received data for the operator 514.

When the operator 514 determines that formation measurements should be taken, the operator 514 provides a measurement command 538 to the computer 160. In response to the command 538, the computer 160 sends a telemetry command 542 to the data module 230 via the MWD 130 to start measurements. In some examples, the operator 514 instructs the computer 160 to send a command to the MWD 130 that instructs the MWD 130 to start sending moving telemetry data frames prior to sending the command 542 to start measurements. Alternatively, the telemetry data frames 530 can include information related to both sliding and moving modes.

Figure 6:
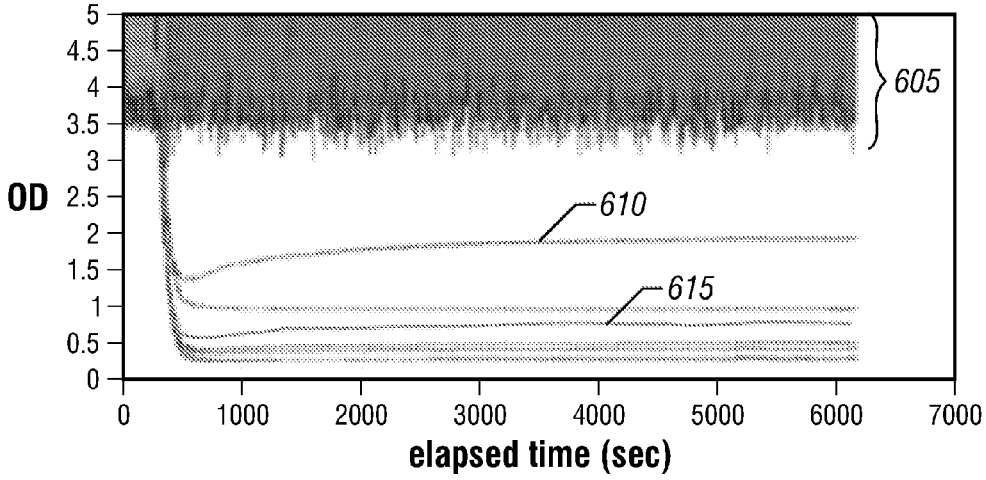
FIG. 6 illustrates an example graph of optical densities of a fluid sample for a plurality of wavelengths.

The data module 230 starts taking formation and/or formation fluid measurements (block 546). These measurements are typically recorded in the downhole tool with a high precision, and at a high rate. Example recorded measurements are illustrated in FIG. 6. The data module 230 selects measurements and associated precisions based on a general-purpose telemetry frame type (block 550), such as the general-purpose frame described below in connection with FIG. 7. The data module 230 sends the selected data in general-purpose telemetry data frames 554 to the computer 160 via the MWD 130. The computer 160 receives the general-purpose telemetry data frames 554 and displays 558 the received data for the operator 514, for example as illustrated in FIG. 8.

Based on the measurements received in the general-purpose telemetry data frames 554, the computer 160 identifies a downhole scenario (block 562). Example methods of identifying a downhole scenario specifically relating to identifying a formation fluid type are described below in connection with FIGS. 9A and 9B. The computer 160 selects a telemetry frame type based on the identified downhole scenario (block 564). Examples of specialized telemetry frames tailored to the identified downhole scenario are described below in connection with FIG. 10. The computer 160 sends a telemetry frame type command 568 that represents the selected frame type to the data module 230 via the MWD 130. In response to the telemetry frame type command 568, the data module 230 selects measurements and/or measurement precisions based on the specified frame type (block 572). Using the selected measurements and associated precisions, the data module 230 sends one or more special-purpose telemetry frames 574, which are constructed in accordance with the specified telemetry frame type, to the computer 160 via the MWD 130. The computer receives the special-purpose telemetry data frames 574 and displays 576 the received data for the operator 514.

If the operator 514 determines based on the displayed data 576 that an incorrect fluid downhole scenario was identified, the computer 160 may be instructed to command the data module 230 to revert to a general-purpose telemetry data frames 554 until a new, more plausible downhole scenario is identified. When a new downhole scenario is identified, the data module 230 is commanded to construct special-purpose telemetry data frames corresponding to the newly identified downhole scenario.

Additionally or alternatively, the operator 514 may decide based on the displayed data 576 that a fluid sample should be taken. If such a decision is made, the computer 160 commands the data module 230 to take and store a fluid sample in a storage chamber of the BHA 100 for subsequent analysis. Moreover, the operator 514 may decide that the data module 230 is to take additional fluid and/or formation measurements, such as a pressure build up measurement. For example, the operator 514 may instruct the computer 160 to send a telemetry frame type command 568 to the data module 230 via the MWD 130 that is particularly suitable for transmitting precision transient pressure data.

In the illustrated example of FIG. 5, the computer 160 identifies the downhole scenario (block 562) and selects the telemetry frame type (block 564). Additionally or alternatively, the operator 514 could have identified the downhole scenario based on the displayed data 558. Further still, the data module 230 could have automatically identified the downhole scenario based on the data selected at block 550, automatically selected the special-purpose telemetry frame type, and started sending the special-purpose telemetry frames 574 without waiting for a command from the computer 160. That is, the operations of blocks 562 and 564 could have been performed by the data module 230.

Moreover, fault, exception and/or error conditions may be used by the data module 230 and/or the surface computer 160 to trigger the transmission of one or more special-purpose telemetry data frames. Such special-purpose telemetry data frames can be used to provide information regarding the fault, exception and/or error to the computer 160 to help the operator 514 handle and/or recover from the fault, exception and/or error, and/or for use in subsequent analyses and/or recovery investigations. In some examples, the data module 230 automatically switches to such special-purpose telemetry data frames upon detection of a fault, exception and/or error for a specified number of data frames and/or time, and then reverts to the previous telemetry frame type. Example faults, exceptions and/or error conditions include, but are not limited to, a high temperature, a low pressure, a high pressure, a power supply interruption, an out of bounds sensor output, a faulty sensor, an abnormal current, an abnormal voltage, an abnormal component temperature, an abnormal hydraulic pressure, a relative position between moving parts, an internal state of a tool (e.g., state machine), missing and/or absent data, an abnormal motor speed, a large force and/or torque, an excessive level of shock and/or vibration, a failed algorithm and/or procedure which could not be satisfactorily completed, etc.

FIG. 6 illustrates a graph of example data that could be collected by the example sensors 305 and 306 and stored in the example measurement database 315 of FIG. 3. The example data may be retrieved from the data module 230 after, for example, the data module 230 is brought to the surface. The example graph of FIG. 6 illustrates optical density values, for ten different wavelengths of a fluid drawn into an LWD module 120, 120A as function of time. The example optical density values illustrated in FIG. 6 may, for example, be measured by the example sensors 305 and 306 of FIG. 3. As illustrated in FIG. 6, three of the optical channels 605 show a noisy and/or very high optical density. As such, the fluid sample is practically opaque at these wavelengths and, thus, there is limited value in transmitting optical density values associated with these optical channels to the surface. Two of the optical channels 610 and 615 demonstrate optical density values that change versus pumpout volume and, thus, may be useful to monitor at an increased frequency and/or precision via a special-purpose telemetry data frame.

Figure 7:
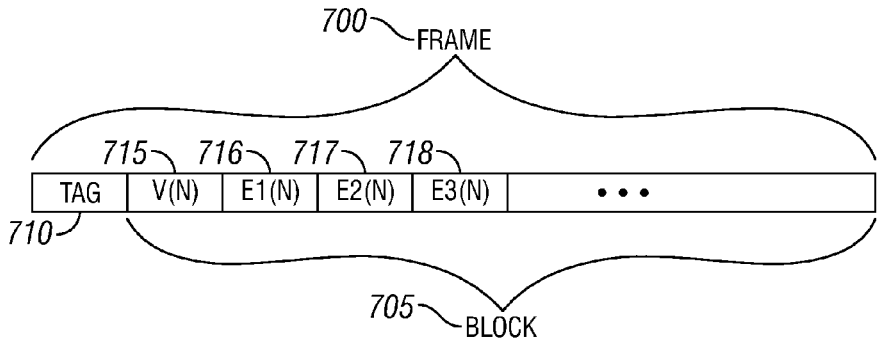
FIG. 7 illustrates an example data structure that may be used to implement a telemetry data frame.
Figure 8:
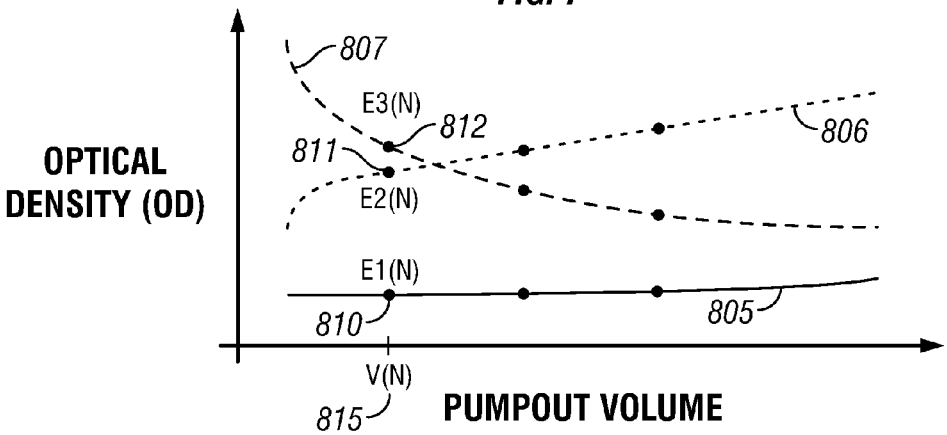
FIG. 8 illustrates an example operator display representing sensor data values received in telemetry data frames.

FIG. 7 illustrates an example data structure 700 that may be used to represent a telemetry frame type. The example frame type 700 shown in FIG. 7 includes one or more blocks of data, one of which is designated at reference numeral 705. To identify a frame type, the example data structure of FIG. 7 includes a tag field 710. The example tag field 710 of FIG. 7 contains a number and/or string that identifies a telemetry frame type. When a device (e.g., the surface computer 160) receives a telemetry frame constructed in accordance with the example data structure of FIG. 7, the device uses the example tag field 710 to identify the corresponding frame type and to determine how the remainder of the frame 700 is to be decoded and/or parsed. For example, to determine which data values are present in the data block 705, at which location in the block 705, and at what precision (i.e., how many bits are used to represent a value).

To represent one or more measurement data values, the example data block 705 of FIG. 7 includes one or more data fields, four of which are represented at reference numerals 715-718. Each of the example data fields 715-718 of FIG. 7 contains a number that represents a measurement value taken at a particular time with a particular precision and for a particular time. The example data field 715 of FIG. 7 contains a number that represents a pumpout volume V(n) recorded or measured at a particular time n. Likewise, the example data fields 716-718 contain numbers that represent three additional sensor measurements E1(*n*), E2(*n*), and E3(*n*), respectively, measured at the same time as the pumpout volume V(n). In an example, the example data block 705 contains, among other things, each of ten optical density values, and data received via such telemetry data frames may be used to construct the example graph of FIG. 8.

In general, a general-purpose telemetry frame type includes: (a) time and/or a measurement of pumped volume, (b) measurements indicative of the presence of water (e.g., flow line fluid resistivity), and (c) measurements indicative of the presence of oil (e.g., optical densities in the visible range or near infrared (NIR) region of 500-1500 nm). Preferably, a general-purpose telemetry frame type also includes additional or supplemental information to increase confidence in a downhole scenario determination. For example, the example general-purpose telemetry frame type may further include: (d) alternative measurements of the presence of water (e.g., optical absorbance in the range of approximately 2000 nm), (e) measurements indicative of the presence of gas (e.g., optical reflection data), (f) a rough hydrocarbon composition obtained, for example, from a downhole spectrometer, the mass fraction of methane, the mass fraction of the group of hydrocarbons in the group comprised of ethane, propane and butane, the mass fraction of the hydrocarbon group comprised of hexane and heavier components, or a gas-oil ratio, and/or (g) a flow line fluid density or flow line fluid viscosity.

In addition to, or instead of, the supplemental data, a general-purpose telemetry frame type may include one or more quality indicators associated with the measurements. Example quality indicators include, but are not limited to, (a) a quality index of gas-oil ratio and hydrocarbon composition computed from optical density data, (b) tool status information (e.g., temperature, voltage, alarms, noise level on LTB, telemetry status, etc.), (c) measurement quality data (e.g., drift on sensors/detectors, noise level, exceeding calibration tolerances, etc.), (d) quality of the process indicators (e.g., catastrophic failures such as not being able to establish or maintain a seal with the wellbore, the presence of a (possibly slow) leak of mud/mud filtrate into the probe while sampling, and/or (e) status of the computations and the performance of algorithms used to derive the desired results. For example, for methane, oil and water concentrations, the color and scattering level, are in theory, determined from the optical density data by matrix inversion (e.g., using singular value decomposition). From these, a gas-oil ratio and a fluid fraction may be determined. Provided the matrix inversion is successful and the derived quantities are with their appropriate physical ranges, single or joint confidence regions for a given level of confidence may be determined using, for example, a covariance matrix. If the derived quantities are found not to be physically reasonable, alternative, but less comprehensive or accurate methods of estimating physical parameters may be used. The formulae used in the latter approach allow cruder estimates of the errors to be determined through an error-propagation method. In either case, the level of confidence for each derived parameter at each instant in the sampling process may be determined and may, for example, be classified into a limited number of categories represented by, for example, a color which may be rendered together with the transmitted data. For example, green may be used to represent good parameters, orange may be used to represent fair parameters, red may be used to represent poor parameters, and white may be used to represent parameters having an unknown quality.

A general-purpose telemetry frame type may, optionally, include: (a) pumped volume computed from the pump characteristics and/or pump stroke, (b) pump out motor sense of rotation (e.g., infer displacement unit stroke direction, "up" and "down" strokes), (c) power turbine angular velocity and/or power output, (d) flow line pressure, flow line fluid temperature and/or wellbore pressure, (e) information related to phase(s) of the sampled fluid (e.g., optical scattering, ultraviolet (UV) fluorescence, flow line fluid density/viscosity), and/or (f) contamination level of the reservoir fluid by the mudcake filtrate.

Information about the sampling job provided by a general-purpose telemetry data frame may be used to control the pumping rate (alternatively, the probe pressure) and/or the pressure applied by the probe packer against the wellbore wall. For example, high optical scattering may be caused by sanding in an unconsolidated formation. If sanding is detected, the pumpout rate may be reduced and/or the probe setting pressure adjusted. UV fluorescence may be indicative of an emulsion of water and oil entering the tool. If emulsion is detected, the pumpout rate may be adjusted. A sudden increase of optical transmission loss may be indicative of a sampling pressure below the bubble point of a light oil, or below the dew point of a gas condensate. It may also be indicative of a sampling pressure below the asphaltene precipitation onset pressure. A lost or leaky seal between the formation and the probe may be detected by a dramatic increase in contamination. If detected, a lost seal may be resolved either by adjusting the probe setting pressure and/or the pumpout rate or by resetting the probe.

An example general-purpose telemetry frame type includes: (a) pumped volume, (b) flow line pressure, (c) flow line fluid temperature, (d) flow line fluid resistivity, (e) flow line fluid density and viscosity, (f) optical absorbance corresponding to wavelengths in the vicinity of the methane peak (NIR), in the vicinity of the water peak (NIR), and at one or more wavelengths in the visible range (color), (g) an optical scattering measurement, (h) a rough hydrocarbon composition (mass fraction or partial densities of C1, C2-C5, C6+), (i) a computed gas-oil ratio, (j) a computed contamination level, (k) a fluorescence measure at two different wavelengths in the UV range, and (l) a quality indicator. In this example, the values are coded with an average of 7 or 8 bits per value after applying a scaling appropriate to each particular measurement (e.g., linearly, logarithmically, geometrically, etc.). Some values such as the quality indicator maybe coded with fewer bits. All of the values correspond to properties measured downhole at substantially the same time. In some examples, the values may be processed, compressed and/or filtered downhole before transmission to reduce noise levels. Assuming a telemetry data rate of approximately 3 bps, such a telemetry data frame may be transmitted twice a minute.

Another example general-purpose telemetry frame type further includes: (a) a computer water fraction, (b) a computed oil fraction, (c) a mass fraction or partial density of CO2, (d) a measurement of HS2 concentration, (e) the pH of the fluid, and (f) data related to NMR spectroscopy and/or mass spectroscopy.

FIG. 8 illustrates an example graph that may be constructed in response to receiving telemetry data frames constructed in accordance with the example telemetry frame type of FIG. 7. The data illustrated in FIG. 8 may be extracted from the example data of FIG. 6 by the example data module 230. As shown in FIG. 8, the pumpout volume V(n) is used to construct the horizontal axis of the graph, and the data values E1(*n*), E2(*n*) and E3(*n*) are use to construct corresponding curves 805, 806 and 807. As illustrated, as each new telemetry data frame is received, a new set of points of the curves is added to the graph. For example, points 810, 811 and 812 correspond to pumpout volume 815. Thus, as the graph evolves in response to received telemetry data frames, the operator can monitor a fluid sampling operation, and/or make downhole scenario determinations.

Graphs such as those illustrated in FIG. 8 may be used by an operator to manually identify a downhole scenario. Example sampling regime changes include, but are not limited to, water-based mud filtrate or oil-based mud filtrate transitioning to light oil, medium oil, heavy oil, volatile oil/gas condensate, gas or water. When such transitions are detected, they can be used, as described above, to select an appropriate special-purpose telemetry frame type. An example special-purpose telemetry frame type is described below in connection with FIG. 10. In general, identifying a sampling regime entails identifying a drilling fluid or mud type (e.g., oil-based mud or water-based mud), which is usually known a priori or can be easily identified, and identifying a formation fluid type. Example processes that may be carried out to implement either or both of the example analyzers 330 and 420, and/or to identify a formation fluid type are described in FIGS. 9A and 9B.

Figure 9A:
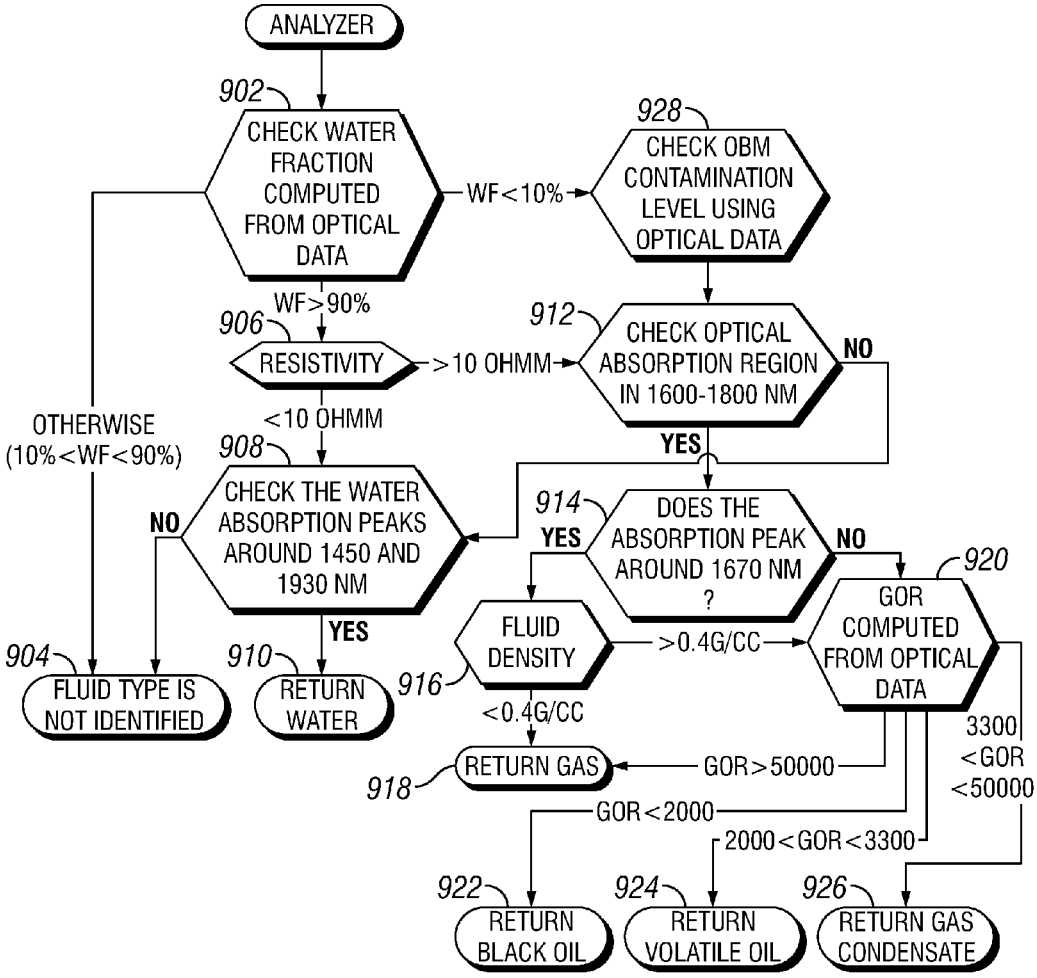
FIGS. 9A and 9B illustrate example processes that may be carried out to determine a fluid type and/or to implement either or both of the example fluid analyzers of FIGS. 4 and 5.

The example process of FIG. 9A may be carried out to identify a fluid type (e.g., water, gas, black oil, volatile oil, gas condensate, etc.) assuming an oil-based mud (OBM). The example process of FIG. 9B may be carried out to identify a formation fluid type (i.e., a downhole scenario) assuming a water-based mud (WBM). Generally, the type of mud (e.g., oil versus water based) is know a priori and/or can be easily determined. Based on the known mud type and a formation fluid type determined, for example, using the process of FIG. 9A or 9B, a downhole scenario can be identified and/or a special-purpose telemetry data frame type can be selected.

Figure 9B:
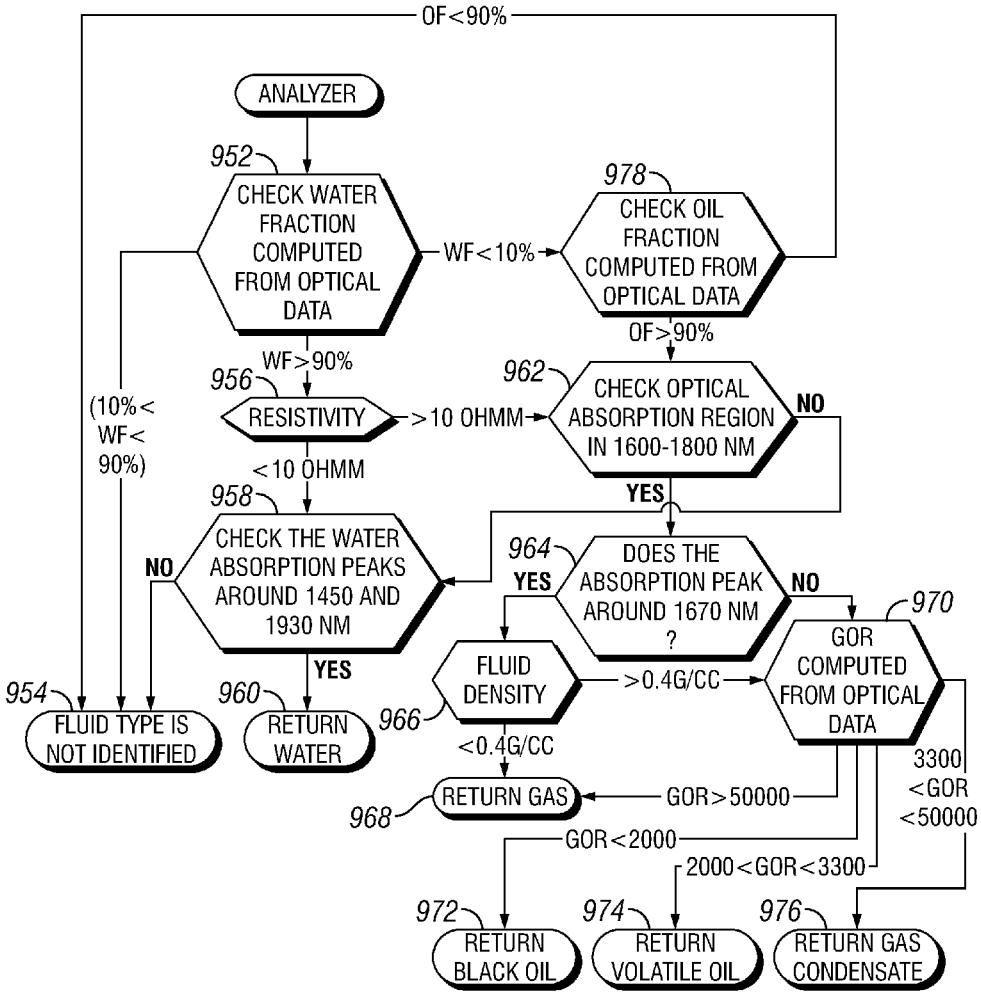

The example processes of FIGS. 9A and 9B may be carried out by a processor, a controller and/or any other suitable processing device. For example, the processes of FIGS. 9A and/or 9B may be embodied in coded instructions stored on a tangible medium such as a flash memory, a read-only memory (ROM) and/or random-access memory (RAM) associated with a processor (e.g., the example processor P105 discussed below in connection with FIG. 15). Alternatively, some or all of the example processes of FIGS. 9A and/or 9B may be implemented using any combination(s) of circuit(s), ASIC(s), PLD(s), FPLD(s), discrete logic, hardware, firmware, etc. Also, some or all of the example processes of FIGS. 9A and/or 9B may be implemented manually or as any combination of any of the foregoing techniques such as, for example, any combination of firmware, software, discrete logic and/or hardware. Further, although the example operations of FIGS. 9A and 9B are described with reference to the flowcharts of FIGS. 9A and 9B, many other methods of implementing the operations of FIGS. 9A and/or 9B may be employed. For example, the order of execution of the blocks may be changed, and/or one or more of the blocks described may be changed, eliminated, sub-divided, or combined. Additionally, any or all of the example processes of FIGS. 9A and/or 9B may be carried out sequentially and/or carried out in parallel by, for example, separate processing threads, processors, devices, discrete logic, circuits, etc.

The example process of FIG. 9A begins with the analyzer 330, 420 checking the water fraction computed from optical data (block 902). If the water fraction is between 10% and 90% (block 902), then a fluid type (i.e., formation fluid type) cannot be identified (block 904). Returning to block 902, if the water fraction is greater than 90% (block 902), the analyzer 330, 420 checks the resistivity of the sample (block 906). If the resistivity less than 10 ohm (Ω)-meter (m) (block 906), the analyzer 330, 420 checks the water absorption peaks around 1450 nm and 1930 nm (block 908). If there is an absorption peak around 1450 nm or 1930 nm (block 908), then the fluid is identified as water (block 910). If there is not an absorption peak around 1450 nm or 1930 nm (block 908), then a fluid type cannot be identified (block 904).

Returning to block 906, if the resistivity is greater than 10 Ω-m (block 906), the analyzer 330, 420 checks optical absorption in the hydrocarbon absorption region (i.e., 1600-1800 nm) (block 912). If there is not an absorption peak in the hydrocarbon absorption region (block 912), control proceeds to block 908 to check for a water absorption peak. If there is an absorption peak in the hydrocarbon absorption region (block 912), the analyzer 330, 420 determines if there is an absorption peak around 1670 nm (block 914). If there is an absorption peak around 1670 nm (block 914) and the fluid density is less than 0.4 gram (g) per cubic centimeter (cc) (block 916), the fluid is identified as gas (block 918).

If there is an absorption peak around 1670 nm (block 914) and the fluid density is greater than 0.4 g/cc (block 916), control proceeds to block 920 to check the gas-oil ratio (GOR).

If there is not an absorption peak around 1670 nm (block 914), the analyzer 330, 420 checks the GOR (block 920). If the GOR is greater than 50,000 (block 920), then the fluid is identified as gas (block 918). If the GOR is less than 2000 (block 920), then the fluid is identified as a black oil (block 922). If the GOR is between 2000 and 3300 (block 920), then the fluid is identified as volatile oil (block 924). If the GOR is between 3300 and 50,000 (block 920), then the fluid is identified as gas condensate (block 926).

Returning to block 902, if the water fraction is less than 10% (block 902), the analyzer 330, 420 checks the OBM contamination level using optical data (block 928). Control then proceeds to block 912 to check optical absorption in the hydrocarbon absorption region.

The example process of FIG. 9B begins with the analyzer 330, 420 checking the water fraction computed from optical data (block 952). If the water fraction is between 10% and 90% (block 952), then a fluid type cannot be identified (block 954). Returning to block 952, if the water fraction is greater than 90% (block 952), the analyzer 330, 420 checks the resistivity of the sample (block 956). If the resistivity less than 10 Ω-m (block 956), the analyzer 330, 420 checks the water absorption peaks around 1450 nm and 1930 nm (block 958). If there is an absorption peak around 1450 nm or 1930 nm (block 958), then the fluid is identified as water (block 960). If there is not an absorption peak around 1450 nm or 1930 nm (block 958), then a fluid type cannot be identified (block 954).

Returning to block 956, if the resistivity is greater than 10 Ω-m (block 956), the analyzer 330, 420 checks optical absorption in the hydrocarbon absorption region (i.e., 1600-1800 nm) (block 962). If there is not an absorption peak in the hydrocarbon absorption region (block 962), control proceeds to block 958 to check for a water absorption peak. If there is an absorption peak in the hydrocarbon absorption region (block 962), the analyzer 330, 420 determines if there is an absorption peak around 1670 nm (block 964). If there is an absorption peak around 1670 nm (block 964) and the fluid density is less than 0.4 gram (g) per cubic centimeter (cc) (block 966), the fluid is identified as gas (block 968).

If there is an absorption peak around 1670 nm (block 964) and the fluid density is greater than 0.4 g/cc (block 966), control proceeds to block 970 to check the gas-oil ratio (GOR).

If there is not an absorption peak around 1670 nm (block 964), the analyzer 330, 420 checks the GOR (block 970). If the GOR is greater than 50,000 (block 970), then the fluid is identified as gas (block 968). If the GOR is less than 2000 (block 970), then the fluid is identified as a black oil (block 972). If the GOR is between 2000 and 3300 (block 970), then the fluid is identified as volatile oil (block 974). If the GOR is between 3300 and 50,000 (block 970), then the fluid is identified as gas condensate (block 976).

Returning to block 952, if the water fraction is less than 10% (block 952), the analyzer 330, 420 checks the oil fraction computed using optical data (block 978). If the oil fraction is less than 90% (block 978), then a fluid type is not identified (block 954). If the oil fraction is greater than 90% (block 978), control then proceeds to block 962 to check optical absorption in the hydrocarbon absorption region.

Figure 10:
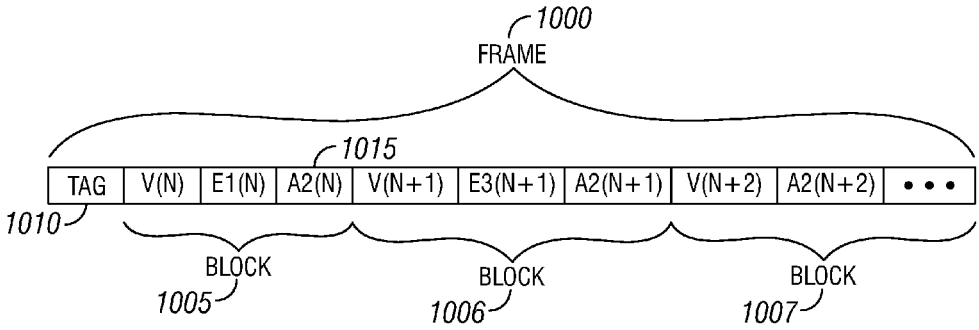
FIG. 10 illustrates another example data structure that may be used to implement a telemetry data frame.

FIG. 10 illustrates another example data structure 1000 that may be used to represent a telemetry frame type. The example frame type 1000 shown in FIG. 10 includes three blocks of data 1005-1007. To identify a frame type, the example data structure 1000 of FIG. 10 includes a tag field 1010. The example tag field 1010 of FIG. 10 contains a number and/or string that identifies a telemetry frame type. The example tag field 1010 may be used, as described above in connection with FIG. 7, by a receiving device to determine a frame type and to decode a telemetry data frame constructed in accordance with the data structure 1000 of FIG. 10.

To represent one or more measurement data values, each of the example data blocks 1005-1007 of FIG. 10 includes one or more data fields, one of which is represented at reference numeral 1015. Each of the example data fields 1015 of FIG. 10 contains a number that represents a measurement value at a particular precision and time. Compared to the telemetry data frames constructed in accordance with the example frame type 700 of FIG. 7, telemetry data frames constructed in accordance with the example frame type 1000 of FIG. 10 provide more frequent representation of the example measurement E2 of FIG. 7. Because the measurement E2 of FIG. 7 is represented with higher precision (e.g., more data bits) in the example of FIG. 10, it is shown in FIG. 10 as measurement A2, although it refers to the same measurement. Because the measurement A2 is of particular interest for an identified downhole scenario, each of the example blocks 1005-1007 of FIG. 10 include the measurement A2. Although measurements (e.g., E1 and E3) continued to be monitored they are conveyed less frequently than the measurement A2, and they are assigned the same low precision used in the example of FIG. 7.

An example special-purpose telemetry frame type applicable to sampling an oil-bearing formation drilled with an oil-based mud includes: (a) pumped volume, (b) two or more absorbance measurements in the hydrocarbon absorbance range of 1600-2000 nm, (c) one or more optical absorbance measurements in the range of 800-1200 nm, (d) one or more absorbance measurements in the visible range (e.g., 400-800 nm) (e) an absorbance measurement in the range corresponding to a CO2 absorption peak, (f) a flow line fluid density and viscosity, (g) a flow line fluid temperature, (h) a flowline fluid pressure, and (i) a quality indicator. In this example, the values are coded with an average of 12 bits per value, although some, such as the quality indicator maybe coded with fewer bits. In some examples, the values may be processed downhole before transmission to reduce noise levels. Assuming a telemetry data rate of approximately 3 bps, such a telemetry data frame may be transmitted once a minute. These values may be further processed at the surface (e.g., by the example surface computer 160) to determine one or more of: (a) a contamination level from optical absorbance measurements in the hydrocarbon absorbance range, (b) a contamination level deduced from optical absorbance measurements in the visible range, (c) composition comprising the mass ratio of C1, C2, C3-C5, C6+ and CO2, and/or (d) a gas-oil ratio.

Another example special-purpose telemetry frame type applicable to sampling an oil-bearing formation drilled with an oil-based mud includes: (a) pumped volume, (b) three absorbance measurements in the hydrocarbon absorbance range of 1600-2000 nm, (c) one or more optical absorbance measurements in the range of 800-1200 nm, (d) one or more absorbance measurements in the visible range (e.g., 400-800 nm) (e) an absorbance measurement in the range corresponding to a CO2 absorption peak, (f) a flow line fluid temperature, (g) a flowline fluid pressure, and (h) a quality indicator. In this example, the values are coded with an average of 12 bits per value, although some like the quality indicator maybe coded with fewer bits. In some examples, the values may be processed downhole before transmission to reduce noise levels. Assuming a telemetry data rate of approximately 3 bps, such a telemetry data frame may be transmitted once a minute.

Another example special-purpose telemetry frame type applicable to sampling a gas-filled formation drilled with an oil-based mud includes: (a) a pumped volume, (b) a plurality of absorbance measurements in the range of 1600-2000 nm, (c) one or more absorbance measurements in the visible range (e.g., 400-800 nm), (d) an absorbance measurement in the range corresponding to a CO2 absorption peak, (e) flow line fluorescence values at one or more wavelengths in the range of 500-700 nm, (f) a flow line fluid pressure, and (g) a quality indicator.

Yet another example special-purpose telemetry frame type applicable to sampling a water-filled formation drilled with an oil-based mud includes: (a) a pumped volume, (b) a flow line fluid resistivity, (c) flow line fluid density and viscosity, (d) a flow line fluid temperature, (e) a pH measurement and/or two or more optical absorbance measurements in the visible or NIR range, (f) a volume fraction of oil and water, (g) a flowline fluid pressure, (h) a quality indicator, and (i) one or more absorbances in the hydrocarbon absorbance range of 1600-1800 nm. Other special-purpose telemetry frame types may be defined for detecting and/or monitoring possible fluid phase separations that may occur in a sampled fluid, although the sampling rate should be adjusted based on data received in one or more general-purpose telemetry data frames.

During a sampling process, a special-purpose telemetry frame type may be selected to monitor the sampling process. An example frame type includes: (a) a pumped volume, (b) a flow line fluid pressure, (c) a wellbore pressure, and (d) a sample bottle pressure. At the end of a sampling process, yet another special-purpose telemetry frame type may be selected to convey (a) one or more fluid properties after correction for contamination, (b) a contamination level and (c) whether not a sample has been captured. A special-purpose telemetry frame type may, additionally or alternatively, be used to represent pressure build-up data following a sampling process that may have perturbed the pressure in the formation. Such a frame type includes a sufficient density of high-resolution pressure measurements, pressure derivatives, temperatures, flow rate, fluid fractions and the times at which the measurements were taken to enable computation of the mobility of the formation, and/or the near wellbore damage or skin.

An operator may also select special-purpose telemetry data frames for any number of additional and/or alternative reasons, such as when a downhole tool is not operating as expected. For example, a diagnostic telemetry frame type that includes downhole tool diagnostic information, such as hydraulic pressure, pump motor rpm, pump temperature, turbine rpm, turbine temperature, driving voltage, current, probe position, and/or piston position could be selected.

While the example telemetry frame types 700 and 1000 include a TAG 710, 1010 that defines a type for the whole telemetry data frame, telemetry data frames can, additionally or alternatively, be constructed to allow telemetry data frames to be constructed while they are being transmitted or on-the-fly. In such an example, each data field has an associated tag that defines the content of the data field. In this way, a telemetry data frame includes a plurality of measurement values together with respective ones of a plurality of tags, where each tag represents a particular measurement (e.g., E1, E2, etc.) and a resolution (e.g., 8-bits or 12-bits). An example tag is represented as E1_12 to indicate that the corresponding data field represents the measurement E1 with 12-bits. Combinations of measurements and resolutions are assigned a unique code and/or value to allow a receiver to correctly decode the data field. However, to reduce the number of bits needed to represent a tag not all combinations of measurement and resolution needs to be allowed. In some examples, on-the fly telemetry data frames are used in combination with telemetry data frames constructed using a frame type tag, as described above in connection with FIGS. 7 and 10.

Figure 12:
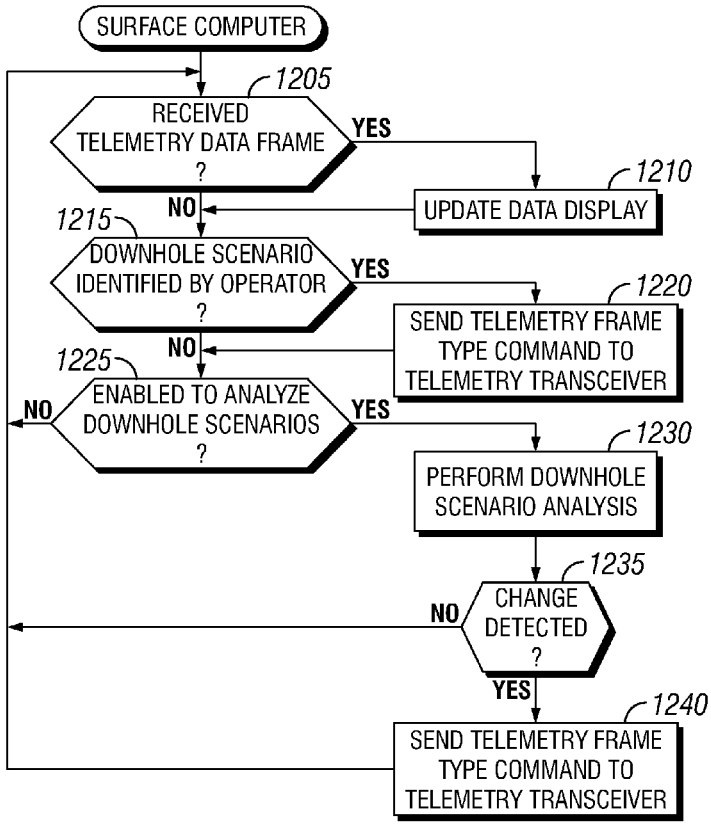
FIG. 12 illustrates an example process that may be carried out to implement either or both of the example logging and control computers of FIGS. 1 and 4.
Figure 11:
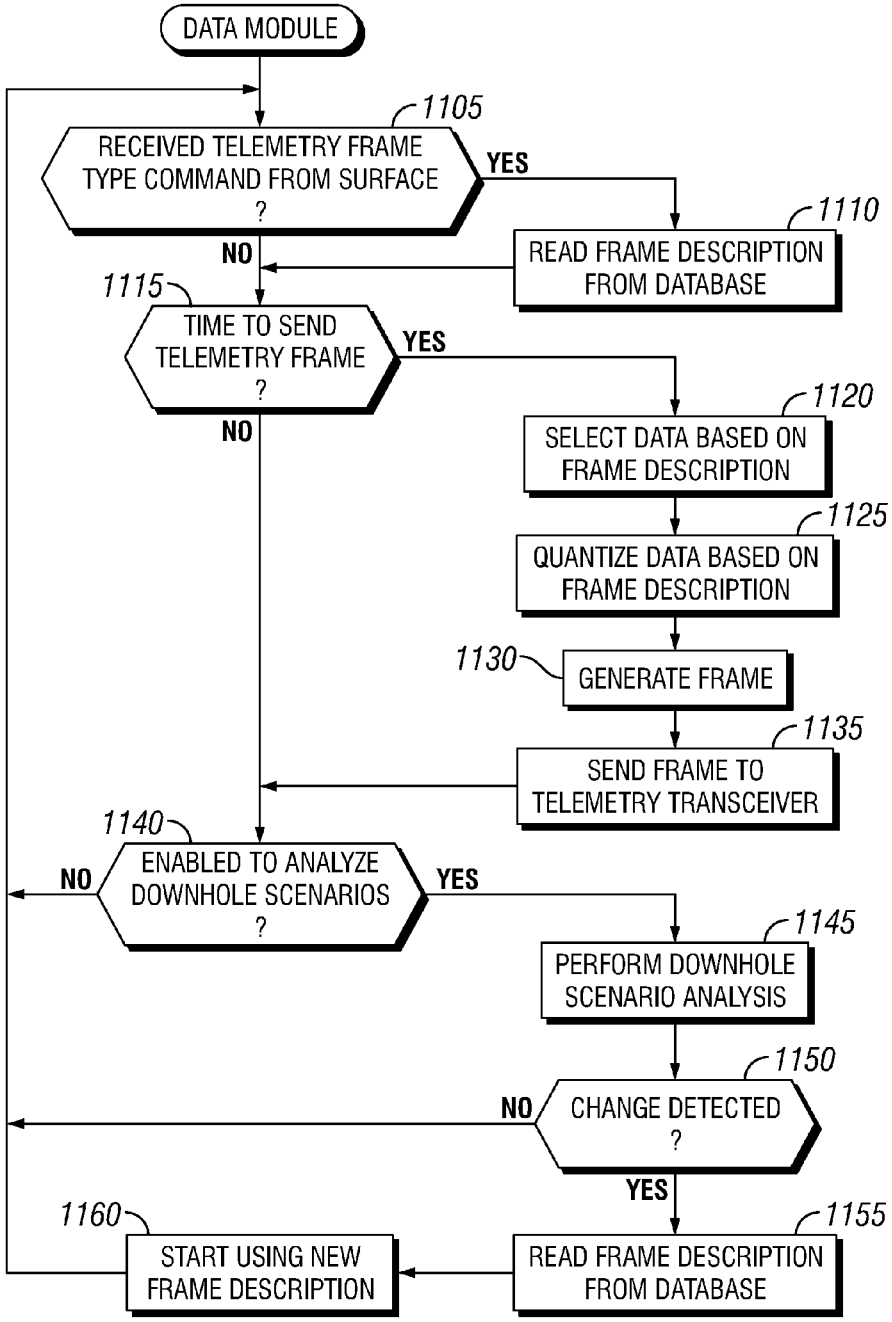
FIG. 11 illustrates an example process that may be carried out to implement either or both of the example data modules of FIGS. 2 and 3.
Figure 13:
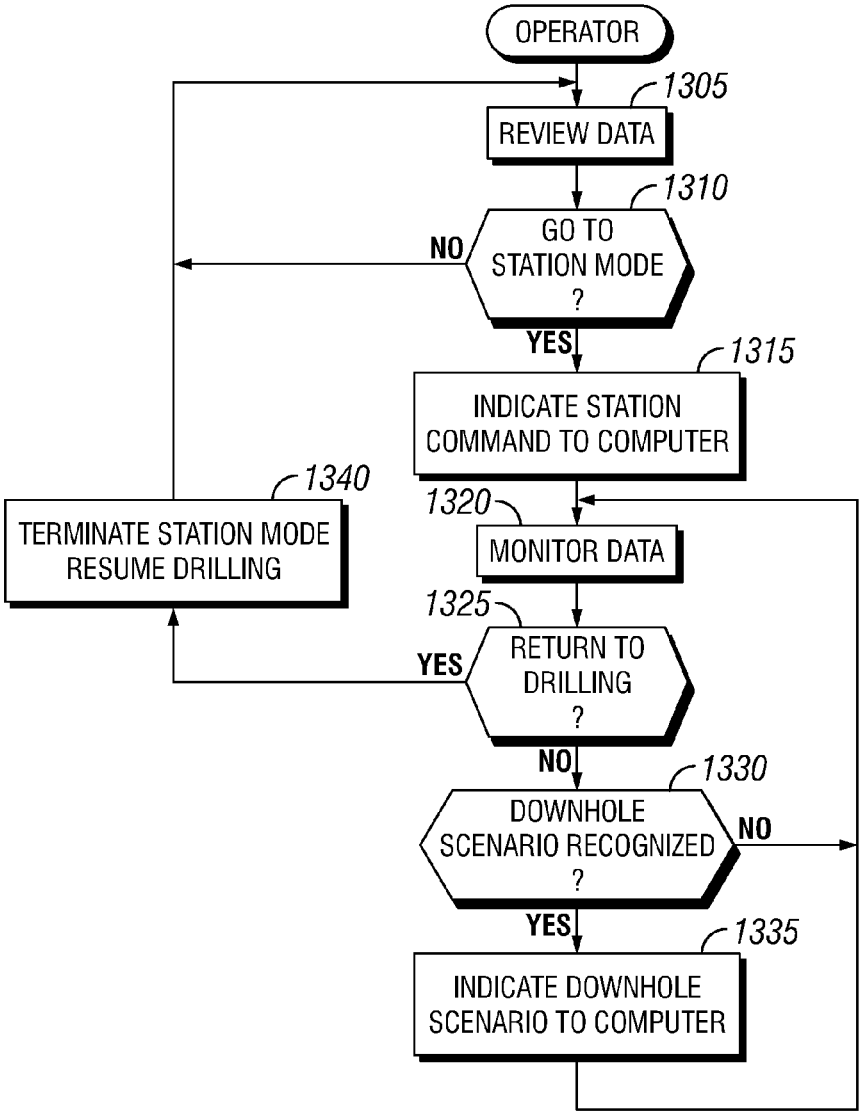
FIG. 13 illustrate an example process that may be carried out by a wellsite operator to control a wellsite drilling operation.

FIG. 11 illustrates an example process that may be carried out to implement either or both of the example data modules 230 of FIGS. 2 and 3. FIG. 12 illustrates an example process that may be carried out to implement either or both of the example surface computers 160 of FIGS. 1 and 4. FIG. 13 illustrates an example process that may be carried out by an operator to control a while-drilling operation. FIGS. 14A-14D illustrate an example process that may be carried out to perform job monitoring for a while-drilling operation.

The example processes of FIGS. 11, 12, 13 and/or 14A-D may be carried out by a processor, a controller and/or any other suitable processing device. For example, the processes of FIGS. 11, 12, 13 and/or 14A-D may be embodied in coded instructions stored on a tangible medium such as a flash memory, a ROM and/or RAM associated with a processor (e.g., the example processor P105 discussed below in connection with FIG. 15). Alternatively, some or all of the example processes of FIGS. 11, 12, 13 and/or 14A-D may be implemented using any combination(s) of circuit(s), ASIC(s), PLD(s), FPLD(s), discrete logic, hardware, firmware, etc. Also, some or all of the example processes of FIGS. 11, 12 and/or 13 may be implemented manually or as any combination of any of the foregoing techniques, for example, any combination of firmware, software, discrete logic and/or hardware. Further, although the example operations of FIGS. 11, 12, 13 and 14A-D are described with reference to the flowcharts of FIGS. 11, 12, 13 and 14A-D, many other methods of implementing the operations of FIGS. 11, 12, 13 and/or 14A-D may be employed. For example, the order of execution of the blocks may be changed, and/or one or more of the blocks described may be changed, eliminated, sub-divided, or combined. Additionally, any or all of the example processes of FIGS. 11, 12, 13 and/or 14A-D may be carried out sequentially and/or carried out in parallel by, for example, separate processing threads, processors, devices, discrete logic, circuits, etc.

The example process of FIG. 11 begins with the example data module 230 determining whether a telemetry frame type command was received from the surface (block 1105). If a telemetry frame type command was received from the surface (block 1105), the example telemetry frame type selector 335 reads a telemetry frame description associated with the specified frame type from the frame type library 340 (block 1110). If a telemetry frame type command was not received (block 1105), control proceeds to block 1115 without reading a telemetry frame description.

The example telemetry data frame builder 320 determines whether it is time to transmit a telemetry data frame (block 1115). If it is time to transmit the next telemetry data frame (block 1115), the telemetry data frame builder 320 selects measurement data from the example measurement database 315 based on the type of telemetry frame to be generated (block 1120), quantizes the selected data (if necessary) based on the type of telemetry frame to be generated (block 1125), and generates the telemetry data frame (block 1130). The telemetry data frame builder 320 then sends the generated telemetry data frame to the example telemetry transceiver 325 (block 1135). If it is not time to transmit a telemetry data frame, control proceeds to block 1140 without generating a telemetry data frame.

If the data module 230 includes the example analyzer 330 and/or the analyzer 330 is enabled (block 1140), the analyzer 330 analyzes sensor outputs to determine if a downhole scenario can be identified (block 1145). If the analyzer 330 is not enabled (block 1140), control returns to block 1105 to check for a telemetry frame type command.

If a new downhole scenario is identified (block 1150), the telemetry frame type selector 335 reads a telemetry frame description associated with identified downhole scenario from the frame type library 340 (block 1155), and starts using the frame description when generating and sending subsequent telemetry data frames (block 1160). Control then returns to block 1105 to check for a telemetry frame type command.

The example process of FIG. 12 begins with the example telemetry interface 405 checking if a telemetry data frame has been received (block 1205). If a telemetry data frame is received (block 1205), the example user interface generator 425 updates a display presented at the example display 440 (block 1210). If a telemetry data frame was not received (block 1205), control proceeds to block 1215 without updating the display.

The example controller 450 checks whether an operator has identified a downhole scenario and indicates the same to the computer 160 via the example input device 445 (block 1215). If the operator has identified a downhole scenario, the telemetry frame type selector selects a corresponding telemetry frame type and sends the same to the example BHA 100 via the example telemetry transceiver 410 (block 1220). If the operator has not made an identification, control proceeds to block 1225 without sending a telemetry frame type command.

If the computer 160 includes the example analyzer 420 and/or the analyzer 420 is enabled (block 1225), the analyzer 420 analyzes received measurement data to determine if a downhole scenario can be identified (block 1230). If the analyzer 420 is not enabled (block 1225), control returns to block 1205 to check for a telemetry data frame. In some examples, the example analyzer 420 is automatically disabled and/or bypassed if the operator identifies a downhole scenario at block 1215.

If a new downhole scenario is identified (block 1235), the telemetry frame type selector 425 selects a corresponding telemetry frame type and sends the same to the BHA 100 via the telemetry transceiver 410 (block 1240). Control then returns to block 1205 to check for a telemetry data frame.

The example process of FIG. 13 begins with an operator reviewing measurement data presented at the example display 440 (block 1305). When the operator wants to perform a station measurement with the BHA 100 (block 1310), the operator inputs a station command to the example computer 160 via the example input device 445 (block 1315).

The operator continues to monitor data presented at the display 440 (block 1320). If based on the presented data, the operator wants to return to drilling (block 1325), the operator terminates station mode, the downhole tool is disengaged from the borehole wall (e.g., retracted) and drilling is resumed (block 1340). The operator then returns to monitoring data at block 1305.

If the operator does not want to return to drilling (block 1325), the operator determines whether a downhole scenario can be identified (block 1330). If a downhole scenario cannot be identified (block 1330), the operator continues monitoring the presented data (block 1320).

If a downhole scenario is identified (block 1330), the operator indicates the downhole scenario to the computer 160 via the input device 445 (block 1335) and continues monitoring data presented at the display 440 (block 1320).

FIGS. 14A-D illustrate an example process that may be carried out by any combination of an operator, a surface computer 160, an LWD module 120, 120A, an MWD module 130, and/or a data module 230 to perform a sampling-while-drilling operation. The example process of FIG. 14A begins with the example MWD module 130 beginning or resuming a drilling operation (block 1402). The MWD module 130 transmits telemetry data to the surface computer 160 to facilitate monitoring of the drilling operation (block 1404). When the operator chooses a sampling point or a point to run an in-situ fluid analysis DFA test (block 1406) based on, for example, formation evaluation logs and/or one or more predefined criteria (block 1408), the computer 160 performs a depth-based correlation with geological features to check that the LWD module 120, 120A (i.e., the sampling tool) is at the correct depth (block 1410). A station command may be sent directly to the LWD module 120, 120A or it may be sent to the MWD module 130, which relays the instruction to the LWD module 120, 120A (block 1412). Drilling is stopped and the MWD module 130 transmits high-resolution pressure telemetry data frames (block 1414). The MWD module 130 or the LWD 120, 120A collects pre-test samples (block 1416) and analyzes the samples for pressure and, in particular, mobility (block 1418). If there is not sufficient mobility to recover a representative formation fluid sample in the desired time (block 1420), the operator may either retract (un-set) the LWD module 120, 120A (block 1495) and move the tool to another, potentially more favorable, depth and try again (block 1497) or control returns to block 1402 to resume drilling (block 1496).

If there is sufficient mobility (block 1420), the LWD 120, 120A checks its status (block 1422) (e.g., checking availability of a sample bottle, available power to operate sampling pump(s), probe setline pressure, and/or tool state machine), activates sampling mode (block 1424), and initiates a pump pretest (block 1426). The LWD module 120, 120A then computes another formation mobility based on pumped fluids (block 1428 of FIG. 14B), sets one or more initial sampling parameters (block 1430) and activates the pump for sampling (block 1432). The LWD module 120, 120A begins sending measurements of the pumped formation fluid(s) via general-purpose telemetry data frames via the MWD module 130 (block 1434). In some examples, the pump pretest (block 1426) and the formation mobility computation (block 1428) operations are omitted. In another example, the formation mobility computed at block 1428 is used to determine whether mobility is sufficient, and if mobility is not sufficient, control proceeds to block 1495.

The operator, the example analyzer 420 and/or the example analyzer 330 monitor(s) the measurements (block 1436) and analyze(s) the measurements to identify a downhole scenario (block 1438). If a downhole scenario is not identified (block 1440), a decision whether to continue pumping is made (block 1442). If pumping is not to continue (block 1442), control proceeds to FIG. 14C at block 1462. If pumping is to continue (block 1442), the operator, the example analyzer 420 and/or the example analyzer 330 determine whether one or more sampling parameters should be changed (block 1444). If a sampling parameter is to be changed (block 1444), the parameter is changed (block 1446) and control returns to block 1434 to continue performing measurements, sending data and analyzing the data.

Returning to block 1440, if a downhole scenario is identified (block 1440), a telemetry frame is constructed in accordance with a telemetry frame type selected based on the identified downhole scenario is initiated (block 1450).

The operator, the example analyzer 420 and/or the example analyzer 330 monitor(s) (block 1452) and analyze(s) the measurements (block 1454). Results of the analysis (block 1454) can, in some examples, be used to adapt and/or learn sampling scenarios and be used to update (block 1456) the example frame type libraries 335, 425. If, as a result of analyzing the measurements at block 1454, the operator, the example analyzer 420 and/or the example analyzer 330 determines that the sampling parameters should be adjusted (block 1448) the sampling parameters are adjusted (block 1449) after which data monitoring resumes (block 1452). If no adjustments to the sampling parameters are desired (block 1448), the process continues to block 1458 of FIG. 14C.

Figure 14A:
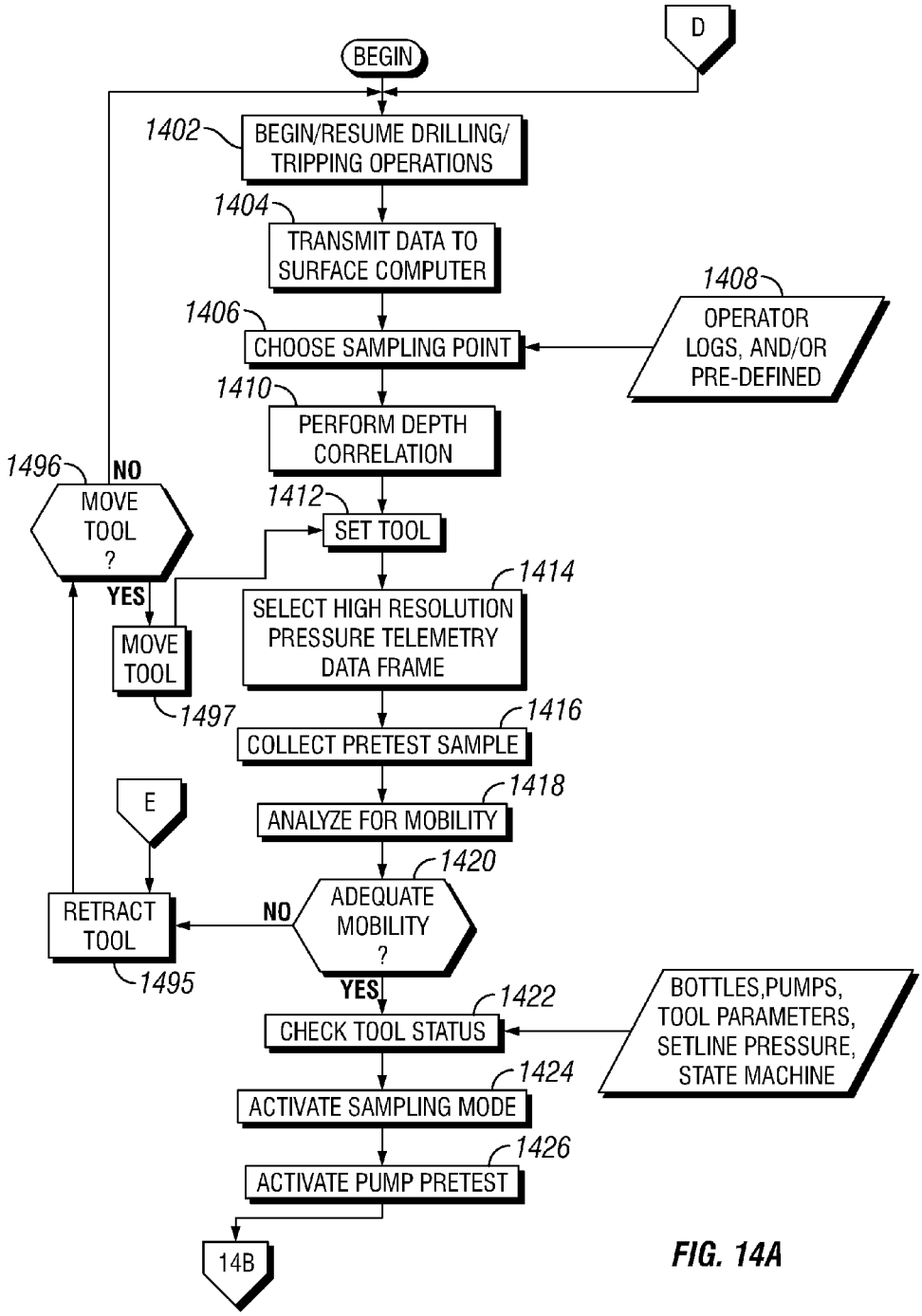
FIGS. 14A-D illustrate an example process that may be carried out to monitor and control a wellsite drilling station.
Figure 14B:
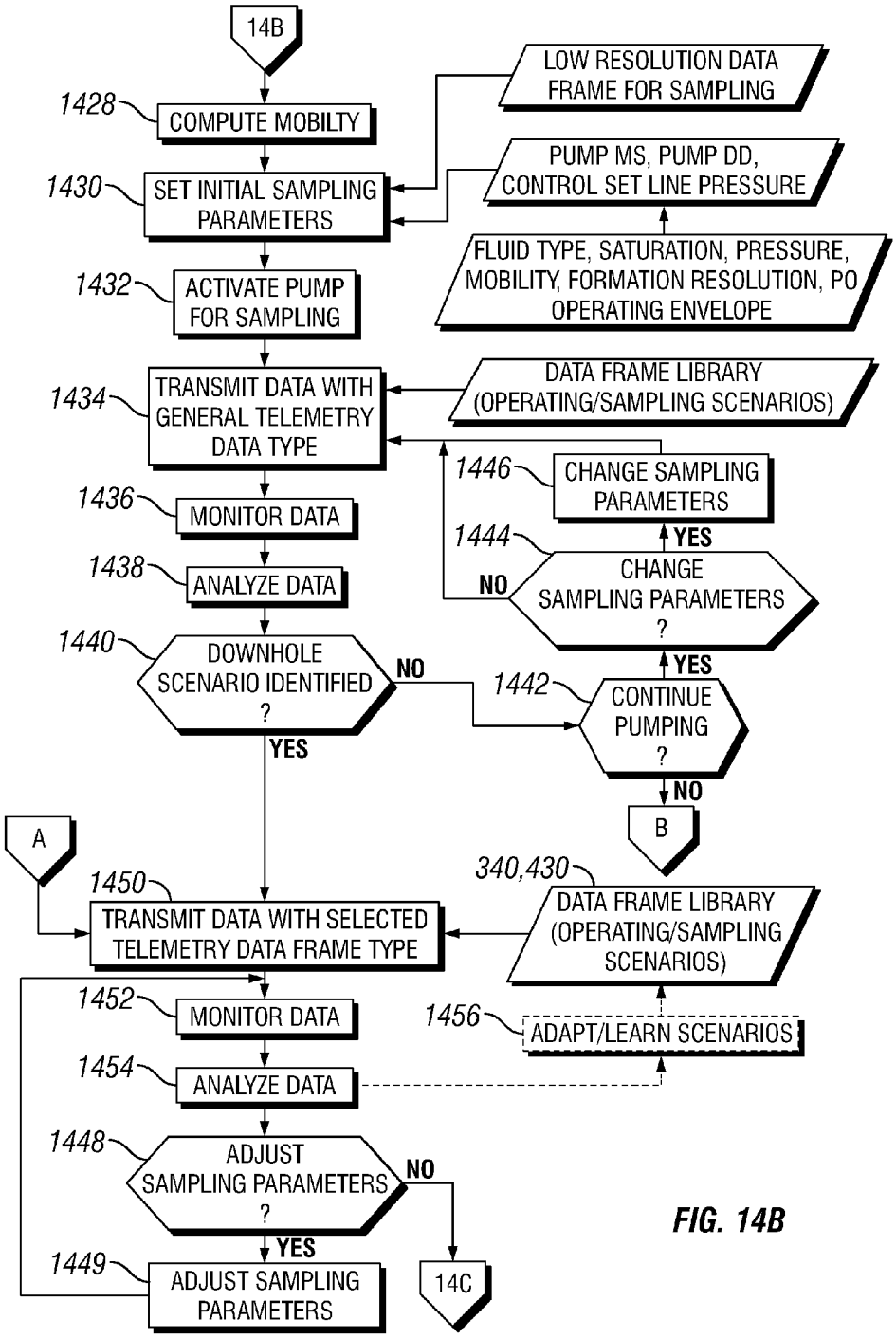
Figure 14C:
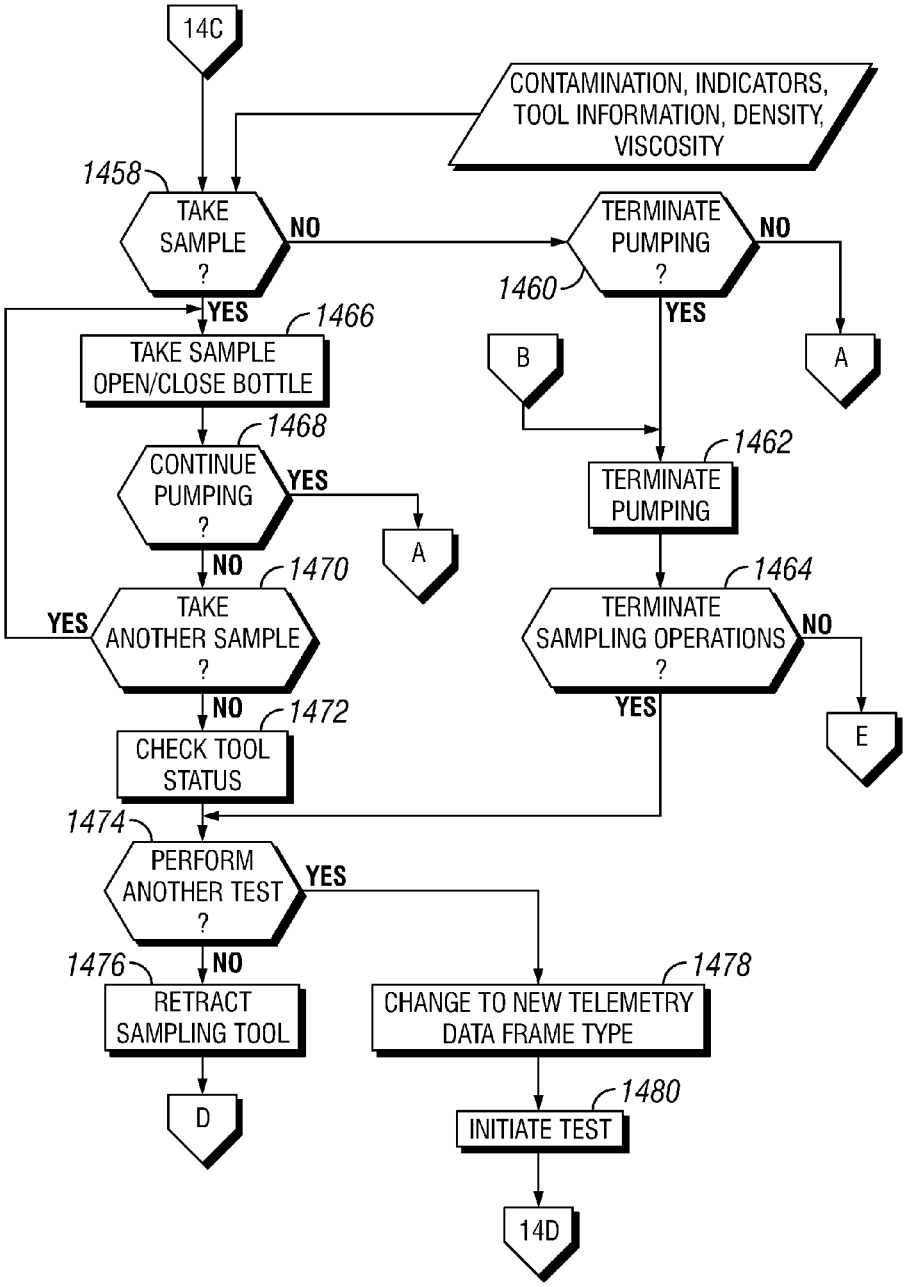
Figure 14D:
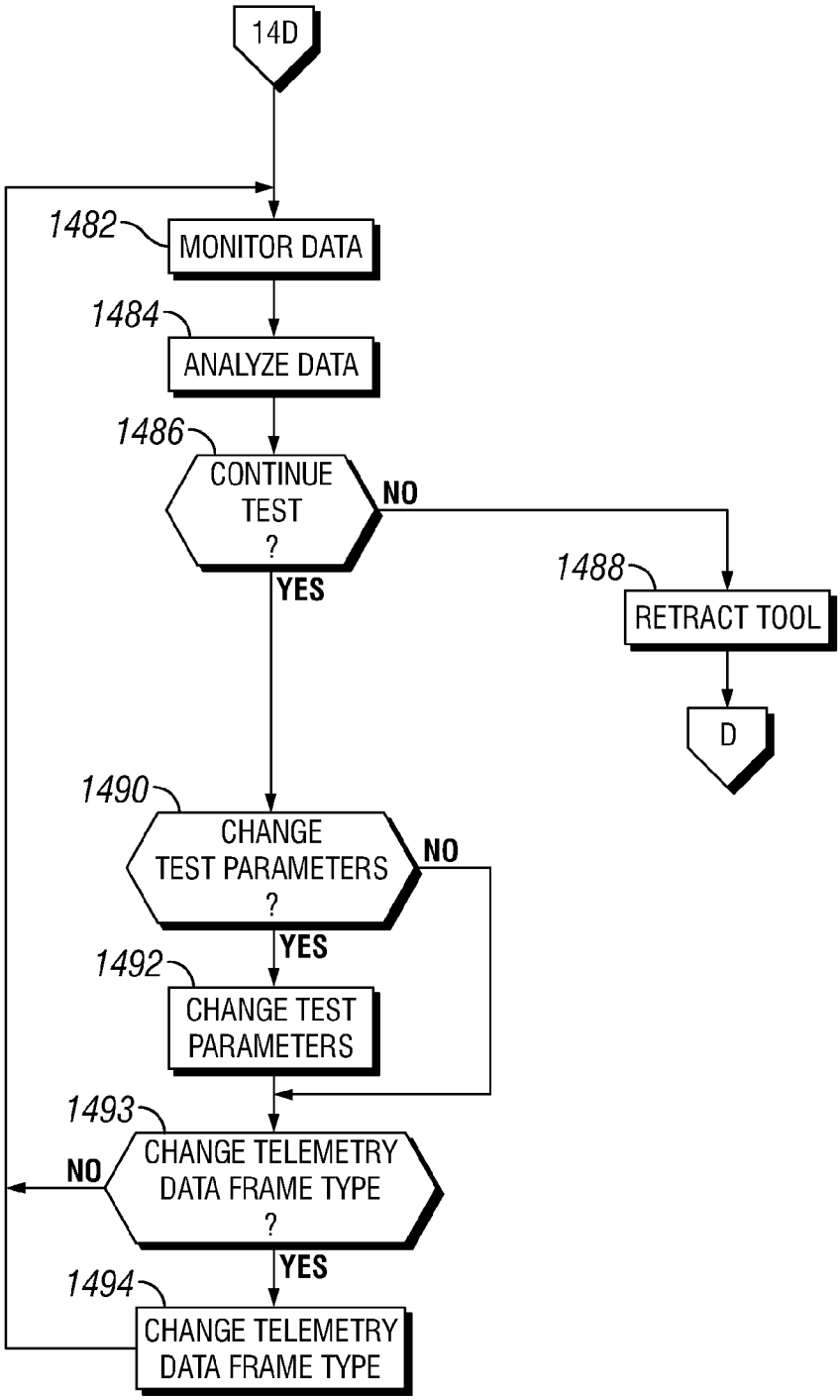

Continuing at block 1458 of FIG. 14C, the operator determines whether a sample is to be collected (block 1458). If a sample is not to be collected (block 1458), the operator determines whether to continue pumpout (block 1460). If pumpout is to be continued (block 1460), control returns to block 1450 of FIG. 14B. If pumpout is not to be continued (block 1460), the LWD module 120, 120A terminates pumpout operations (block 1462). If the sampling operation is to be terminated altogether (block 1464), control proceeds to block 1474. If the sampling operation is to continue (block 1464), but possibly at a different location, control returns to block 1495 of FIG. 14A.

Returning to block 1458, if a sample is to be collected (block 1458), the LWD module 120, 120A takes a sample by opening and closing a sample container (block 1466). If pumping is to continue (block 1468), control returns to block 1450 of FIG. 14B. If pumping is not to continue (block 1468), the LWD module 120, 120A checks whether another sample is to be collected (block 1470). If another sample is to be collected (block 1470), control returns to block 1466. If another sample is not to be collected (block 1470), the status of the LWD module 120, 120A is checked (block 1472). If another test, for example a test other than sampling, is not to be performed (block 1474), the LWD module 120, 120A is retracted (block 1476), and control returns to block 1402 of FIG. 14A to resume drilling operations.

If another test is to be performed (block 1474), the data module 230 changes to a corresponding telemetry frame type (block 1478) and the LWD module 120, 120A initiates the requested test (block 1480). The operator, the example analyzer 420 and/or the example analyzer 330 monitor(s) the measurements (block 1482 of FIG. 14D) and analyze(s) the measurements (block 1484) to determine whether the test should be continued (block 1486). If the test is not to be continued, the LWD module 120, 120A is retracted (block 1488), and control returns to block 1402 of FIG. 14A to resume drilling operations.

If the test is to be continued (block 1486), the LWD module 120, 120A determines whether any test parameters are to be changed (block 1490). If any test parameter is to be changed (block 1490), the parameter is changed (block 1492). Alternatively, or in addition, the operator has the option to change the telemetry data frame type (block 1493). If the telemetry frame type is to be changed (block 1493), the telemetry frame type is changed (block 1494) and control returns to block 1482 to continue monitoring measurements. If the telemetry data frame type is not to be changed (block 1493), control returns to block 1482 without changing the telemetry frame type.

Figure 15:
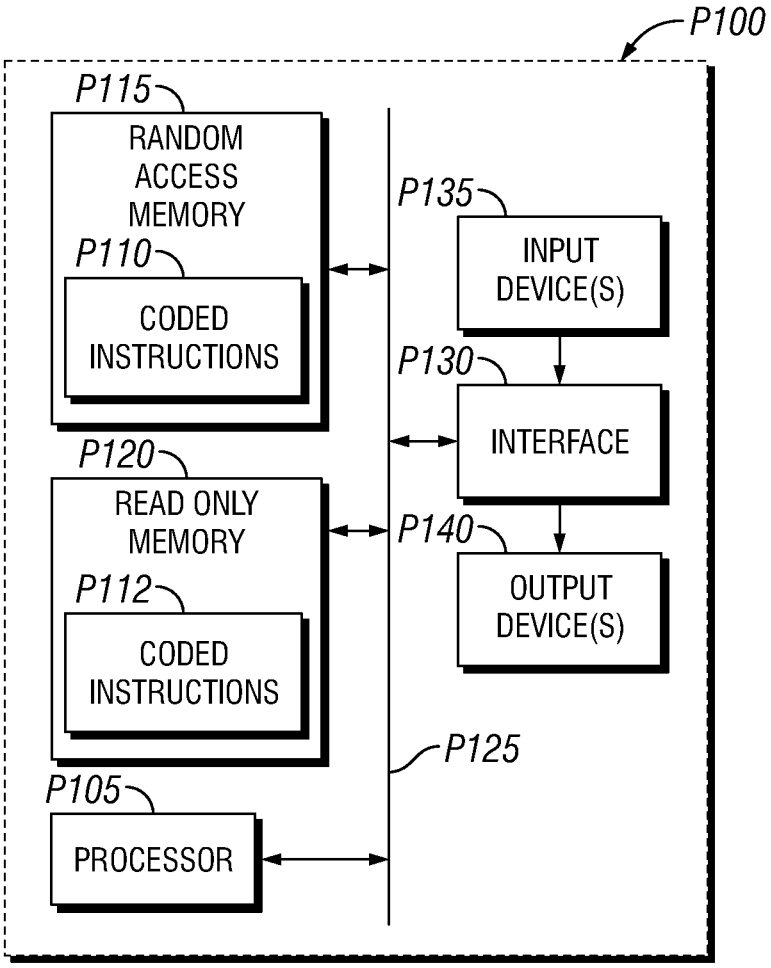
FIG. 15 is a schematic illustration of an example processor platform that may be used and/or programmed to implement the example data module of FIG. 2, the example surface computer of FIG. 1 and/or to carry out any or all of the example processes described herein.

FIG. 15 is a schematic diagram of an example processor platform P100 that may be used and/or programmed to implement all or a portion of any or all of the example LWD modules 120, 120A, the data modules 230 and/or the example surface computers 160 disclosed herein. For example, the processor platform P100 can be implemented by one or more general-purpose processors, processor cores, microcontrollers, etc.

The processor platform P100 of the example of FIG. 15 includes at least one general-purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example processes of FIGS. 11-13 and/or 14A-D to implement the example methods and apparatus described herein.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown). The memory P115, P120 may be used to, for example, implement either or both of the example frame type libraries 340 and 430 and/or either or both of the example measurement databases 315 and 415.

The processor platform P100 also includes an interface circuit P130. The interface circuit P130 may be implemented by any type of interface standard, such as an external memory interface, serial port, general-purpose input/output, etc. One or more input devices P135 and one or more output devices P140 are connected to the interface circuit P130. The example output device P140 may be used to, for example, implement the example display 440 of FIG. 4. The example input device P135 may be used to, for example, implement the example input device 445.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method comprising:

identifying a downhole scenario based on a property of an underground geological formation;

selecting a first telemetry frame type based on the identified downhole scenario;

conveying an identifier representative of the selected first telemetry frame type to a downhole fluid sampling tool; and receiving a first telemetry data frame from the downhole fluid sampling tool, the first telemetry data frame containing first fluid analysis parameters for a fluid, and being constructed in accordance with the selected first telemetry frame type.

2. The method as defined in claim 1, further comprising receiving a second telemetry data frame from a second downhole fluid sampling tool, the second telemetry data frame conveying information associated with the property of the formation.

3. The method as defined in claim 2, comprising conveying an identifier representative of the second telemetry frame type to the downhole fluid sampling tool in response to determining that an incorrect downhole scenario was identified.

4. The method as defined in claim 2, wherein the second telemetry data frame is constructed in accordance with a second telemetry frame type different from the first telemetry frame type.

5. The method as defined in claim 2, wherein the second downhole fluid sampling tool comprises the first downhole fluid sampling tool.

6. The method as defined in claim 2, wherein the second telemetry data frame conveys second fluid analysis parameters for a second fluid, and wherein at least one of the second fluid analysis parameters differs from one of the first fluid analysis parameters.

7. The method as defined in claim 6, wherein the one of the second fluid analysis parameters differs from the one of the first fluid analysis parameters in at least one of a parameter type, a parameter resolution or a frequency of conveyance.

8. The method as defined in claim 1, wherein the property of the formation is measured at a first location of the formation, and the first telemetry data frame contains fluid analysis parameters for a fluid sample associated with a second location of the formation.

9. The method as defined in claim 8, wherein the first location of the formation comprises a first wellbore in the formation, and the second location of the formation comprises a second wellbore in the formation.

10. The method as defined in claim 1, wherein the property of the formation is at least one of a formation resistivity, a formation porosity, a formation bulk density, an identified formation fluid type, or a pressure gradient.

11. The method as defined in claim 1, wherein the identifier is conveyed to the downhole sampling tool before the downhole sampling tool is placed into a wellbore.

12. The method as defined in claim 1, further comprising: presenting the property of the formation to an operator; and receiving the identified fluid type from the operator.

13. The method as defined in claim 1, wherein the downhole scenario is identified using a basin or reservoir model representing fluid flow in the underground geological formation.

14. The method as defined in claim 1 wherein:

the downhole scenario comprises at least one of a formation fluid type, an operating condition, a formation dynamic property, a tool status, a tool condition, a drilling fluid type, a sampling regime, a formation property, a wellbore property, a downhole tool property, or a formation fluid property; and the formation fluid type comprises at least one of water, heavy oil, black oil, volatile oil, wet gas, dry gas, or gas condensate.

15. The method of claim 1 wherein identifying a downhole scenario comprises determining whether a fault condition exists, and wherein selecting the first telemetry frame type is based on whether the fault condition exists.

16. The method of claim 1, wherein the first telemetry frame type defines a subset of sensor outputs to be conveyed within the first telemetry data frame.

17. The method of claim 1, wherein the first telemetry frame type defines a precision level for a sensor output to be conveyed within the first telemetry data frame.

18. The method of claim 1, wherein selecting a first telemetry frame type comprises selecting the first telemetry frame type from a library of frame types.

* * * * *